US012746596B2

(12) United States Patent
Badwe et al.

(10) Patent No.: US 12,746,596 B2
(45) Date of Patent: Sep. 29, 2026

(54) SYSTEMS AND METHODS FOR SYNTHESIS OF SPHEROIDIZED METAL POWDERS

(71) Applicant: 6K Inc., North Andover, MA (US)

(72) Inventors: Sunil Bhalchandra Badwe, Export, PA (US); Scott Joseph Turchetti, Newburyport, MA (US); Sudip Bhattacharya, Billerica, MA (US); Makhlouf Redjdal, Melrose, MA (US)

(73) Assignee: 6K Inc., North Andover, MA (US)

( * ) Notice: Subject to any disclaimer, the term of this patent is extended or adjusted under 35 U.S.C. 154(b) by 0 days.

(21) Appl. No.: 18/513,326

(22) Filed: Nov. 17, 2023

(65) Prior Publication Data

US 2024/0342791 A1 Oct. 17, 2024

Related U.S. Application Data

(62) Division of application No. 17/451,716, filed on Oct. 21, 2021, now Pat. No. 11,919,071.

(Continued)

(51) Int. Cl.

| | |
|---|---|
| ***B22F 1/065*** | (2022.01) |
| ***B22F 1/05*** | (2022.01) |
| ***B22F 9/14*** | (2006.01) |

(52) U.S. Cl.

CPC ..... *B22F 1/065* (2022.01); *B22F 1/05* (2022.01); *B22F 9/14* (2013.01); *B22F 2202/13* (2013.01);

(Continued)

(58) Field of Classification Search

CPC .... B22F 9/14; B22F 1/05; B22F 1/065; B22F 2202/13; B22F 1/142; C01B 21/0761;

(Continued)

(56) References Cited

U.S. PATENT DOCUMENTS

| | | | |
|---|---|---|---|
| 1,699,205 | A | 1/1929 | Emil et al. |
| 2,892,215 | A | 6/1959 | Gerhard et al. |

(Continued)

FOREIGN PATENT DOCUMENTS

| | | | |
|---|---|---|---|
| AU | 2003211869 | A1 | 9/2003 |
| AU | 2014394102 | B2 | 6/2020 |

(Continued)

OTHER PUBLICATIONS

Wang, Y. et al., "Developments in Nanostructured Cathode Materials for High-Performance Lithium-Ion Batteries", Advanced Materials, Jun. 2008, pp. 2251-2269.

(Continued)

*Primary Examiner* — Ricardo D Morales

(74) *Attorney, Agent, or Firm* — Knobbe, Martens, Olson & Bear, LLP

(57) ABSTRACT

Disclosed herein are embodiments of systems and method for processing feedstock materials using microwave plasma processing. Specifically, the feedstock materials disclosed herein pertain to metal powders. Microwave plasma processing can be used to spheroidize the metal powders and form metal nitride or metal carbide powders. The stoichiometry of the metal nitride or metal carbide powders can be controlled by changing the composition of the plasma gas and the residence time of the feedstock materials during plasma processing.

16 Claims, 6 Drawing Sheets

Related U.S. Application Data

(60) Provisional application No. 63/108,118, filed on Oct. 30, 2020.

(52) U.S. Cl.
CPC ..... *B22F 2302/20* (2013.01); *B22F 2304/10* (2013.01)

(58) Field of Classification Search
CPC ..... C04B 35/58014; C04B 35/62865; C04B 2235/528; C22C 1/056
See application file for complete search history.

(56) References Cited

U.S. PATENT DOCUMENTS 3,010,009 A 11/1961 Ducati
3,290,723 A 12/1966 John et al.
3,293,334 A 12/1966 Bylund et al.
3,434,831 A 3/1969 Knopp
3,466,165 A 9/1969 Rhys et al.
RE26,879 E 5/1970 Kelso
3,652,259 A 3/1972 Knopp
3,802,816 A 4/1974 Kaufmann
3,845,344 A 10/1974 Rainer
3,909,241 A 9/1975 Cheney et al.
3,966,374 A 6/1976 Honnorat et al.
3,974,245 A 8/1976 Cheney et al.
4,076,640 A 2/1978 Forgensi et al.
4,177,026 A 12/1979 Honnorat et al.
4,212,837 A 7/1980 Kubo et al.
4,221,554 A 9/1980 Oguchi et al.
4,221,775 A 9/1980 Anno
4,265,730 A 5/1981 Hirose et al.
4,423,303 A 12/1983 Hirose et al.
4,431,449 A 2/1984 Dillon et al.
4,439,410 A 3/1984 Santen et al.
4,544,404 A 10/1985 Yolton et al.
4,569,823 A 2/1986 Westin
4,599,880 A 7/1986 Stepanenko et al.
4,611,108 A 9/1986 Leprince et al.
4,670,047 A 6/1987 Kopatz et al.
4,692,584 A 9/1987 Caneer, Jr.
4,705,560 A 11/1987 Kemp et al.
4,711,660 A 12/1987 Kemp et al.
4,711,661 A 12/1987 Kemp et al.
4,714,587 A 12/1987 Eylon et al.
4,731,110 A 3/1988 Kopatz et al.
4,731,111 A 3/1988 Kopatz et al.
4,772,315 A 9/1988 Johnson et al.
4,778,515 A 10/1988 Kemp et al.
4,780,131 A 10/1988 Kemp et al.
4,780,881 A 10/1988 Zhang et al.
4,783,216 A 11/1988 Kemp et al.
4,783,218 A 11/1988 Kemp et al.
4,787,934 A 11/1988 Johnson et al.
4,802,915 A 2/1989 Kopatz et al.
4,836,850 A 6/1989 Kemp et al.
4,859,237 A 8/1989 Johnson et al.
4,923,509 A 5/1990 Kemp et al.
4,923,531 A 5/1990 Fisher
4,943,322 A 7/1990 Kemp et al.
4,944,797 A 7/1990 Kemp et al.
4,952,389 A 8/1990 Szymanski et al.
4,957,062 A 9/1990 Schuurmans et al.
5,002,646 A * 3/1991 Egerton ..... C01B 21/0821 204/178
5,022,935 A 6/1991 Fisher
5,022,936 A 6/1991 Tsujimura et al.
5,032,202 A 7/1991 Tsai et al.
5,041,713 A 8/1991 Weidman
5,095,048 A 3/1992 Takahashi et al.
5,114,471 A 5/1992 Johnson et al.
5,126,104 A 6/1992 Anand et al.
5,131,992 A 7/1992 Church et al.
5,200,595 A 4/1993 Boulos et al.
5,234,526 A 8/1993 Chen et al.
5,290,507 A 3/1994 Runkle
5,292,370 A 3/1994 Tsai et al.
5,370,765 A 12/1994 Dandl
5,376,475 A 12/1994 Ovshinsky et al.
5,395,453 A 3/1995 Noda
5,411,592 A 5/1995 Ovshinsky et al.
5,431,967 A 7/1995 Manthiram et al.
5,518,831 A 5/1996 Tou et al.
5,567,243 A 10/1996 Foster et al.
5,601,883 A 2/1997 Yamazaki
5,665,640 A 9/1997 Foster et al.
5,671,045 A 9/1997 Woskov et al.
5,676,919 A 10/1997 Kawamura et al.
5,702,530 A 12/1997 Shan et al.
5,750,013 A 5/1998 Lin
5,776,323 A 7/1998 Kobashi
5,866,213 A 2/1999 Foster et al.
5,876,684 A 3/1999 Withers et al.
5,909,277 A 6/1999 Woskov et al.
5,958,361 A 9/1999 Laine et al.
5,969,352 A 10/1999 French et al.
5,980,977 A 11/1999 Deng et al.
5,989,648 A 11/1999 Phillips
6,013,155 A 1/2000 Mcmillin et al.
6,027,585 A 2/2000 Patterson et al.
6,200,651 B1 3/2001 Roche et al.
6,221,125 B1 4/2001 Soda et al.
6,261,484 B1 7/2001 Phillips et al.
6,274,110 B1 8/2001 Kim et al.
6,329,628 B1 12/2001 Kuo et al.
6,334,882 B1 1/2002 Aaslund
6,340,863 B1 1/2002 Ikeda et al.
6,362,449 B1 3/2002 Hadidi et al.
6,376,027 B1 4/2002 Lee et al.
6,383,953 B2 5/2002 Hwang
6,409,851 B1 6/2002 Sethuram et al.
6,428,600 B1 8/2002 Flurschuetz et al.
6,461,972 B1 10/2002 Kabansky
6,518,667 B1 2/2003 Ichida et al.
6,543,380 B1 4/2003 Sung-Spitzl
6,551,377 B1 4/2003 Leonhardt
6,558,848 B1 5/2003 Kobayashi et al.
6,569,397 B1 5/2003 Yadav et al.
6,579,573 B2 6/2003 Strutt et al.
6,589,311 B1 7/2003 Han et al.
6,607,693 B1 8/2003 Saito et al.
6,652,822 B2 11/2003 Phillips et al.
6,676,728 B2 1/2004 Han et al.
6,689,192 B1 2/2004 Phillips et al.
6,752,979 B1 6/2004 Talbot et al.
6,755,886 B2 6/2004 Phillips et al.
6,780,219 B2 8/2004 Singh et al.
6,793,849 B1 9/2004 Gruen et al.
6,805,822 B2 10/2004 Takei et al.
6,832,735 B2 12/2004 Yadav et al.
6,838,072 B1 1/2005 Kong et al.
6,869,550 B2 3/2005 Dorfman et al.
6,902,745 B2 6/2005 Lee et al.
6,919,257 B2 7/2005 Gealy et al.
6,919,527 B2 7/2005 Boulos et al.
6,989,529 B2 1/2006 Wiseman
7,066,980 B2 6/2006 Akimoto et al.
7,091,441 B1 8/2006 Kuo
7,108,733 B2 9/2006 Enokido
7,125,537 B2 10/2006 Liao et al.
7,125,822 B2 10/2006 Nakano et al.
7,175,786 B2 2/2007 Celikkaya et al.
7,182,929 B1 2/2007 Singhal et al.
7,220,398 B2 5/2007 Sutorik et al.
7,235,118 B2 6/2007 Bouaricha et al.
7,285,194 B2 10/2007 Uno et al.
7,285,307 B2 10/2007 Hohenthanner et al.
7,297,310 B1 11/2007 Peng et al.
7,297,892 B2 11/2007 Kelley et al.
7,344,776 B2 3/2008 Kollmann et al.
7,357,910 B2 4/2008 Phillips et al.
7,368,130 B2 5/2008 Kim et al.
7,374,704 B2 5/2008 Che et al.

(56) References Cited

U.S. PATENT DOCUMENTS

| | | | |
|---|---|---|---|
| 7,375,303 | B2 | 5/2008 | Twarog |
| 7,381,496 | B2 | 6/2008 | Onnerud et al. |
| 7,431,750 | B2 | 10/2008 | Liao et al. |
| 7,442,271 | B2 | 10/2008 | Asmussen et al. |
| 7,491,468 | B2 | 2/2009 | Okada et al. |
| 7,517,513 | B2 | 4/2009 | Sarkas et al. |
| 7,524,353 | B2 | 4/2009 | Johnson et al. |
| 7,534,296 | B2 | 5/2009 | Swain et al. |
| 7,572,315 | B2 | 8/2009 | Boulos et al. |
| 7,622,211 | B2 | 11/2009 | Vyas et al. |
| 7,629,553 | B2 | 12/2009 | Fanson et al. |
| 7,700,152 | B2 | 4/2010 | Laine et al. |
| 7,776,303 | B2 | 8/2010 | Hung et al. |
| 7,806,077 | B2 | 10/2010 | Lee et al. |
| 7,828,999 | B2 | 11/2010 | Yubuta et al. |
| 7,901,658 | B2 | 3/2011 | Weppner et al. |
| 7,931,836 | B2 | 4/2011 | Xie et al. |
| 7,939,141 | B2 | 5/2011 | Matthews et al. |
| 8,007,691 | B2 | 8/2011 | Sawaki et al. |
| 8,043,405 | B2 | 10/2011 | Johnson et al. |
| 8,092,941 | B2 | 1/2012 | Weppner et al. |
| 8,101,061 | B2 | 1/2012 | Suh et al. |
| 8,168,128 | B2 | 5/2012 | Seeley et al. |
| 8,178,240 | B2 | 5/2012 | Wang et al. |
| 8,192,865 | B2 | 6/2012 | Buiel et al. |
| 8,193,291 | B2 | 6/2012 | Zhang |
| 8,211,388 | B2 | 7/2012 | Woodfield et al. |
| 8,221,853 | B2 | 7/2012 | Marcinek et al. |
| 8,268,230 | B2 | 9/2012 | Cherepy et al. |
| 8,283,275 | B2 | 10/2012 | Heo et al. |
| 8,303,926 | B1 | 11/2012 | Luhrs et al. |
| 8,329,090 | B2 | 12/2012 | Hollingsworth et al. |
| 8,329,257 | B2 | 12/2012 | Larouche et al. |
| 8,338,323 | B2 | 12/2012 | Takasu et al. |
| 8,389,160 | B2 | 3/2013 | Venkatachalam et al. |
| 8,420,043 | B2 | 4/2013 | Gamo et al. |
| 8,439,998 | B2 | 5/2013 | Ito et al. |
| 8,449,950 | B2 | 5/2013 | Shang et al. |
| 8,478,785 | B2 | 7/2013 | Jamjoom et al. |
| 8,492,303 | B2 | 7/2013 | Bulan et al. |
| 8,529,996 | B2 | 9/2013 | Bocian et al. |
| 8,592,767 | B2 | 11/2013 | Rappe et al. |
| 8,597,722 | B2 | 12/2013 | Albano et al. |
| 8,623,555 | B2 | 1/2014 | Kang et al. |
| 8,658,317 | B2 | 2/2014 | Weppner et al. |
| 8,685,593 | B2 | 4/2014 | Dadheech et al. |
| 8,728,680 | B2 | 5/2014 | Mikhail et al. |
| 8,735,022 | B2 | 5/2014 | Schlag et al. |
| 8,748,785 | B2 | 6/2014 | Jordan et al. |
| 8,758,957 | B2 | 6/2014 | Dadheech et al. |
| 8,784,706 | B2 | 7/2014 | Shevchenko et al. |
| 8,822,000 | B2 | 9/2014 | Kumagai et al. |
| 8,840,701 | B2 | 9/2014 | Borland et al. |
| 8,877,119 | B2 | 11/2014 | Jordan et al. |
| 8,882,007 | B1 | 11/2014 | Smith et al. |
| 8,911,529 | B2 | 12/2014 | Withers et al. |
| 8,919,428 | B2 | 12/2014 | Cola et al. |
| 8,945,431 | B2 | 2/2015 | Schulz et al. |
| 8,951,496 | B2 | 2/2015 | Hadidi et al. |
| 8,956,785 | B2 | 2/2015 | Dadheech et al. |
| 8,968,587 | B2 | 3/2015 | Shin et al. |
| 8,968,669 | B2 | 3/2015 | Chen |
| 8,980,485 | B2 | 3/2015 | Lanning et al. |
| 8,999,440 | B2 | 4/2015 | Zenasni et al. |
| 9,023,259 | B2 | 5/2015 | Hadidi et al. |
| 9,051,647 | B2 | 6/2015 | Cooperberg et al. |
| 9,065,141 | B2 | 6/2015 | Merzougui et al. |
| 9,067,264 | B2 | 6/2015 | Moxson et al. |
| 9,079,778 | B2 | 7/2015 | Kelley et al. |
| 9,085,490 | B2 | 7/2015 | Taylor et al. |
| 9,101,982 | B2 | 8/2015 | Aslund |
| 9,136,569 | B2 | 9/2015 | Song et al. |
| 9,150,422 | B2 | 10/2015 | Nakayama et al. |
| 9,193,133 | B2 | 11/2015 | Shin et al. |
| 9,196,901 | B2 | 11/2015 | Se-Hee et al. |
| 9,196,905 | B2 | 11/2015 | Tzeng et al. |
| 9,206,085 | B2 | 12/2015 | Hadidi et al. |
| 9,242,224 | B2 | 1/2016 | Redjdal et al. |
| 9,259,785 | B2 | 2/2016 | Hadidi et al. |
| 9,293,302 | B2 | 3/2016 | Risby et al. |
| 9,321,071 | B2 | 4/2016 | Jordan et al. |
| 9,322,081 | B2 | 4/2016 | Mchugh et al. |
| 9,352,278 | B2 | 5/2016 | Spatz et al. |
| 9,356,281 | B2 | 5/2016 | Verbrugge et al. |
| 9,368,772 | B1 | 6/2016 | Chen et al. |
| 9,378,928 | B2 | 6/2016 | Zeng et al. |
| 9,412,998 | B2 | 8/2016 | Rojeski et al. |
| 9,421,612 | B2 | 8/2016 | Fang et al. |
| 9,425,463 | B2 | 8/2016 | Hsu et al. |
| 9,463,435 | B2 | 10/2016 | Schulz et al. |
| 9,463,984 | B2 | 10/2016 | Sun et al. |
| 9,520,593 | B2 | 12/2016 | Sun et al. |
| 9,520,600 | B2 | 12/2016 | Dadheech et al. |
| 9,624,565 | B2 | 4/2017 | Lee et al. |
| 9,627,150 | B2 | 4/2017 | Sasaki et al. |
| 9,630,162 | B1 | 4/2017 | Sunkara et al. |
| 9,643,891 | B2 | 5/2017 | Hadidi et al. |
| 9,700,877 | B2 | 7/2017 | Kim et al. |
| 9,705,136 | B2 | 7/2017 | Rojeski |
| 9,718,131 | B2 | 8/2017 | Boulos et al. |
| 9,735,427 | B2 | 8/2017 | Zhang |
| 9,738,788 | B1 | 8/2017 | Gross et al. |
| 9,751,129 | B2 | 9/2017 | Boulos et al. |
| 9,767,990 | B2 | 9/2017 | Zeng et al. |
| 9,768,033 | B2 | 9/2017 | Ranjan et al. |
| 9,776,378 | B2 | 10/2017 | Choi |
| 9,782,791 | B2 | 10/2017 | Redjdal et al. |
| 9,782,828 | B2 | 10/2017 | Wilkinson |
| 9,796,019 | B2 | 10/2017 | She et al. |
| 9,796,020 | B2 | 10/2017 | Aslund |
| 9,831,503 | B2 | 11/2017 | Sopchak |
| 9,871,248 | B2 | 1/2018 | Rayner et al. |
| 9,879,344 | B2 | 1/2018 | Lee et al. |
| 9,899,674 | B2 | 2/2018 | Hirai et al. |
| 9,917,299 | B2 | 3/2018 | Behan et al. |
| 9,932,673 | B2 | 4/2018 | Jordan et al. |
| 9,945,034 | B2 | 4/2018 | Yao et al. |
| 9,945,564 | B2 | 4/2018 | Gao et al. |
| 9,947,926 | B2 | 4/2018 | Kim et al. |
| 9,981,284 | B2 | 5/2018 | Guo et al. |
| 9,991,458 | B2 | 6/2018 | Rosenman et al. |
| 9,999,922 | B1 | 6/2018 | Struve |
| 10,011,491 | B2 | 7/2018 | Lee et al. |
| 10,050,303 | B2 | 8/2018 | Anandan et al. |
| 10,057,986 | B2 | 8/2018 | Prud'homme et al. |
| 10,065,240 | B2 | 9/2018 | Chen |
| 10,079,392 | B2 | 9/2018 | Huang et al. |
| 10,116,000 | B1 | 10/2018 | Federici et al. |
| 10,130,994 | B2 | 11/2018 | Fang et al. |
| 10,167,556 | B2 | 1/2019 | Ruzic et al. |
| 10,170,753 | B2 | 1/2019 | Ren et al. |
| 10,193,142 | B2 | 1/2019 | Rojeski |
| 10,244,614 | B2 | 3/2019 | Foret |
| 10,279,531 | B2 | 5/2019 | Pagliarini |
| 10,283,757 | B2 | 5/2019 | Noh et al. |
| 10,319,537 | B2 | 6/2019 | Claussen et al. |
| 10,333,183 | B2 | 6/2019 | Sloop |
| 10,350,680 | B2 | 7/2019 | Yamamoto et al. |
| 10,403,475 | B2 | 9/2019 | Cooperberg et al. |
| 10,411,253 | B2 | 9/2019 | Tzeng et al. |
| 10,439,206 | B2 | 10/2019 | Behan et al. |
| 10,442,000 | B2 | 10/2019 | Fukada et al. |
| 10,461,298 | B2 | 10/2019 | Herle |
| 10,472,497 | B2 | 11/2019 | Stowell et al. |
| 10,477,665 | B2 | 11/2019 | Hadidi et al. |
| 10,493,524 | B2 | 12/2019 | She et al. |
| 10,522,300 | B2 | 12/2019 | Yang |
| 10,526,684 | B2 | 1/2020 | Ekman et al. |
| 10,529,486 | B2 | 1/2020 | Nishisaka |
| 10,543,534 | B2 | 1/2020 | Hadidi et al. |
| 10,584,923 | B2 | 3/2020 | De et al. |
| 10,593,985 | B2 | 3/2020 | Sastry et al. |
| 10,610,929 | B2 | 4/2020 | Fang et al. |
| 10,637,029 | B2 | 4/2020 | Gotlib Vainshtein et al. |

(56) References Cited

U.S. PATENT DOCUMENTS

| | | | |
|---|---|---|---|
| 10,638,592 | B2 | 4/2020 | Foret |
| 10,639,712 | B2 | 5/2020 | Barnes et al. |
| 10,647,824 | B2 | 5/2020 | Hwang et al. |
| 10,655,206 | B2 | 5/2020 | Moon et al. |
| 10,665,890 | B2 | 5/2020 | Kang et al. |
| 10,668,566 | B2 | 6/2020 | Smathers et al. |
| 10,669,437 | B2 | 6/2020 | Cox et al. |
| 10,688,564 | B2 | 6/2020 | Boulos et al. |
| 10,707,477 | B2 | 7/2020 | Sastry et al. |
| 10,717,150 | B2 | 7/2020 | Aleksandrov et al. |
| 10,727,477 | B2 | 7/2020 | Kim et al. |
| 10,741,845 | B2 | 8/2020 | Yushin et al. |
| 10,744,590 | B2 | 8/2020 | Maier et al. |
| 10,756,334 | B2 | 8/2020 | Stowell et al. |
| 10,766,787 | B1 | 9/2020 | Sunkara et al. |
| 10,777,804 | B2 | 9/2020 | Sastry et al. |
| 10,781,103 | B2 | 9/2020 | Tanner et al. |
| 10,843,925 | B1 | 11/2020 | Kroeger et al. |
| 10,858,255 | B2 | 12/2020 | Koziol et al. |
| 10,858,500 | B2 | 12/2020 | Chen et al. |
| 10,892,477 | B2 | 1/2021 | Choi et al. |
| 10,930,473 | B2 | 2/2021 | Paukner et al. |
| 10,930,922 | B2 | 2/2021 | Sun et al. |
| 10,937,632 | B2 | 3/2021 | Stowell et al. |
| 10,943,744 | B2 | 3/2021 | Sungail et al. |
| 10,944,093 | B2 | 3/2021 | Paz et al. |
| 10,950,856 | B2 | 3/2021 | Park et al. |
| 10,964,938 | B2 | 3/2021 | Rojeski |
| 10,987,735 | B2 | 4/2021 | Hadidi et al. |
| 10,998,552 | B2 | 5/2021 | Lanning et al. |
| 11,011,388 | B2 | 5/2021 | Eason et al. |
| 11,031,641 | B2 | 6/2021 | Gupta et al. |
| 11,050,061 | B2 | 6/2021 | Kim et al. |
| 11,072,533 | B2 | 7/2021 | Shevchenko et al. |
| 11,077,497 | B2 | 8/2021 | Motchenbacher et al. |
| 11,077,524 | B2 | 8/2021 | Smathers et al. |
| 11,108,050 | B2 | 8/2021 | Kim et al. |
| 11,116,000 | B2 | 9/2021 | Sandberg et al. |
| 11,130,175 | B2 | 9/2021 | Parrish et al. |
| 11,130,994 | B2 | 9/2021 | Shachar et al. |
| 11,133,495 | B2 | 9/2021 | Gazda et al. |
| 11,148,202 | B2 | 10/2021 | Hadidi et al. |
| 11,167,556 | B2 | 11/2021 | Shimada et al. |
| 11,170,753 | B2 | 11/2021 | Nomura et al. |
| 11,171,322 | B2 | 11/2021 | Seol et al. |
| 11,183,682 | B2 | 11/2021 | Sunkara et al. |
| 11,193,142 | B2 | 12/2021 | Angelidaki et al. |
| 11,196,045 | B2 | 12/2021 | Dadheech et al. |
| 11,219,884 | B2 | 1/2022 | Takeda et al. |
| 11,235,385 | B2 | 2/2022 | Larouche et al. |
| 11,244,614 | B2 | 2/2022 | He et al. |
| 11,245,065 | B1 | 2/2022 | Ouderkirk et al. |
| 11,245,109 | B2 | 2/2022 | Tzeng et al. |
| 11,254,585 | B2 | 2/2022 | Ekman et al. |
| 11,273,322 | B2 | 3/2022 | Zanata et al. |
| 11,273,491 | B2 | 3/2022 | Barnes et al. |
| 11,299,397 | B2 | 4/2022 | Lanning et al. |
| 11,311,937 | B2 | 4/2022 | Hadidi et al. |
| 11,311,938 | B2 | 4/2022 | Badwe et al. |
| 11,319,537 | B2 | 5/2022 | Dames et al. |
| 11,333,183 | B2 | 5/2022 | Desai et al. |
| 11,335,911 | B2 | 5/2022 | Lanning et al. |
| 11,350,680 | B2 | 6/2022 | Rutkoski et al. |
| 11,411,253 | B2 | 8/2022 | Busacca et al. |
| 11,433,369 | B1 | 9/2022 | Nicole et al. |
| 11,439,206 | B2 | 9/2022 | Santos |
| 11,442,000 | B2 | 9/2022 | Vaez-Iravani et al. |
| 11,461,298 | B1 | 10/2022 | Shemmer et al. |
| 11,462,728 | B2 | 10/2022 | Stowell et al. |
| 11,465,201 | B2 | 10/2022 | Barnes et al. |
| 11,471,941 | B2 | 10/2022 | Barnes et al. |
| 11,477,665 | B2 | 10/2022 | Franke et al. |
| 11,479,674 | B2 | 10/2022 | Nakamura et al. |
| 11,577,314 | B2 | 2/2023 | Hadidi et al. |
| 11,590,568 | B2 | 2/2023 | Badwe et al. |
| 11,611,130 | B2 | 3/2023 | Wrobel et al. |
| 11,633,785 | B2 | 4/2023 | Badwe et al. |
| 11,654,483 | B2 | 5/2023 | Larouche et al. |
| 11,717,886 | B2 | 8/2023 | Badwe et al. |
| 11,839,919 | B2 | 12/2023 | Hadidi et al. |
| 11,855,278 | B2 | 12/2023 | Holman et al. |
| 11,919,071 | B2 | 3/2024 | Badwe et al. |
| 11,923,176 | B2 | 3/2024 | Stowell et al. |
| 11,963,287 | B2 | 4/2024 | Shang et al. |
| 12,040,162 | B2 | 7/2024 | Kozlowski et al. |
| 12,042,861 | B2 | 7/2024 | Badwe |
| 12,094,688 | B2 | 9/2024 | Kozlowski et al. |
| 12,176,529 | B2 | 12/2024 | Holman et al. |
| 12,214,420 | B2 | 2/2025 | Hadidi et al. |
| 12,261,023 | B2 | 3/2025 | Holman et al. |
| 12,311,447 | B2 | 5/2025 | Barnes et al. |
| 12,406,829 | B2 | 9/2025 | Holman |
| 2001/0016283 | A1 | 8/2001 | Shiraishi et al. |
| 2001/0021740 | A1 | 9/2001 | Lodyga et al. |
| 2002/0054912 | A1 | 5/2002 | Kim et al. |
| 2002/0112794 | A1 | 8/2002 | Sethuram et al. |
| 2003/0024806 | A1 | 2/2003 | Foret |
| 2003/0027021 | A1 | 2/2003 | Sharivker et al. |
| 2003/0055594 | A1 | 3/2003 | Bunker et al. |
| 2003/0070620 | A1 | 4/2003 | Cooperberg et al. |
| 2003/0129497 | A1 | 7/2003 | Yamamoto et al. |
| 2003/0172772 | A1 | 9/2003 | Sethuram et al. |
| 2003/0186128 | A1 | 10/2003 | Singh et al. |
| 2003/0207978 | A1 | 11/2003 | Yadav et al. |
| 2004/0013941 | A1 | 1/2004 | Kobayashi et al. |
| 2004/0045807 | A1 | 3/2004 | Sarkas et al. |
| 2004/0060387 | A1 | 4/2004 | Tanner-Jones |
| 2004/0123699 | A1 | 7/2004 | Liao et al. |
| 2004/0247522 | A1 | 12/2004 | Mills |
| 2005/0005844 | A1 | 1/2005 | Kitagawa et al. |
| 2005/0025698 | A1 | 2/2005 | Talbot et al. |
| 2005/0072496 | A1 | 4/2005 | Hwang et al. |
| 2005/0163696 | A1 | 7/2005 | Uhm et al. |
| 2005/0242070 | A1 | 11/2005 | Hammer |
| 2005/0260786 | A1 | 11/2005 | Yoshikawa et al. |
| 2006/0040168 | A1 | 2/2006 | Sridhar |
| 2006/0040182 | A1 | 2/2006 | Kawakami et al. |
| 2006/0045822 | A1 | 3/2006 | Timmons et al. |
| 2006/0069176 | A1 | 3/2006 | Bowman et al. |
| 2006/0106146 | A1 | 5/2006 | Xia et al. |
| 2006/0141153 | A1 | 6/2006 | Kubota et al. |
| 2006/0145124 | A1 | 7/2006 | Hsiao et al. |
| 2006/0291827 | A1 | 12/2006 | Suib et al. |
| 2007/0077350 | A1 | 4/2007 | Hohenthanner et al. |
| 2007/0089860 | A1 | 4/2007 | Hou et al. |
| 2007/0092432 | A1 | 4/2007 | Prud et al. |
| 2007/0209758 | A1 | 9/2007 | Sompalli et al. |
| 2007/0221635 | A1 | 9/2007 | Boulos et al. |
| 2007/0259768 | A1 | 11/2007 | Kear et al. |
| 2008/0029485 | A1 | 2/2008 | Kelley et al. |
| 2008/0055594 | A1 | 3/2008 | Hadidi et al. |
| 2008/0153962 | A1 | 6/2008 | Xia et al. |
| 2008/0182114 | A1 | 7/2008 | Kim et al. |
| 2008/0220244 | A1 | 9/2008 | Wai et al. |
| 2008/0286490 | A1 | 11/2008 | Bogdanoff et al. |
| 2008/0296268 | A1 | 12/2008 | Mike et al. |
| 2008/0305025 | A1 | 12/2008 | Vitner et al. |
| 2009/0061322 | A1 | 3/2009 | Kawakami et al. |
| 2009/0074655 | A1 | 3/2009 | Suciu |
| 2009/0093553 | A1 | 4/2009 | Kleine et al. |
| 2009/0107290 | A1 | 4/2009 | Rosocha et al. |
| 2009/0155689 | A1 | 6/2009 | Zaghib et al. |
| 2009/0176034 | A1 | 7/2009 | Ruuttu et al. |
| 2009/0196801 | A1 | 8/2009 | Mills |
| 2009/0202869 | A1 | 8/2009 | Sawaki et al. |
| 2009/0246398 | A1 | 10/2009 | Kurahashi et al. |
| 2009/0258255 | A1 | 10/2009 | Terashima et al. |
| 2009/0266487 | A1 | 10/2009 | Tian et al. |
| 2009/0304941 | A1 | 12/2009 | Mclean |
| 2009/0305132 | A1 | 12/2009 | Gauthier et al. |
| 2010/0007162 | A1 | 1/2010 | Han et al. |
| 2010/0096362 | A1 | 4/2010 | Hirayama et al. |
| 2010/0173098 | A1 | 7/2010 | Nagata et al. |
| 2010/0176524 | A1 | 7/2010 | Burgess et al. |

(56) References Cited

U.S. PATENT DOCUMENTS

2010/0219062 A1 9/2010 Leon Sanchez
2010/0301212 A1 12/2010 Dato et al.
2010/0320176 A1 12/2010 Mohanty et al.
2011/0005461 A1 1/2011 Vandermeulen
2011/0006254 A1 1/2011 Richard et al.
2012/0015284 A1 1/2012 Merzougui et al.
2012/0027955 A1 2/2012 Sunkara et al.
2012/0034135 A1 2/2012 Risby
2012/0048064 A1 3/2012 Kasper et al.
2012/0051962 A1 3/2012 Imam et al.
2012/0074342 A1 3/2012 Kim et al.
2012/0100438 A1 4/2012 Fasching et al.
2012/0112379 A1 5/2012 Beppu et al.
2012/0122017 A1 5/2012 Mills
2012/0224175 A1 9/2012 Minghetti
2012/0230860 A1 9/2012 Ward-Close et al.
2012/0240726 A1 9/2012 Kim et al.
2012/0294919 A1 11/2012 Jaynes et al.
2012/0295033 A1 11/2012 Kim et al.
2013/0032753 A1 2/2013 Yamamoto et al.
2013/0071284 A1 3/2013 Kano et al.
2013/0075390 A1 3/2013 Ashida
2013/0078508 A1 3/2013 Tolbert et al.
2013/0084474 A1 4/2013 Mills
2013/0087285 A1 4/2013 Kofuji et al.
2014/0048516 A1 2/2014 Gorodetsky et al.
2014/0113453 A1 4/2014 Shih et al.
2014/0202286 A1 7/2014 Yokoyama et al.
2014/0271843 A1 9/2014 Ma et al.
2014/0272430 A1 9/2014 Kalayaraman
2014/0322632 A1 10/2014 Sugimoto et al.
2014/0373344 A1 12/2014 Takada et al.
2015/0000844 A1 1/2015 Woo
2015/0101454 A1 4/2015 Shimizu et al.
2015/0167143 A1 6/2015 Luce et al.
2015/0171455 A1 6/2015 Mills
2015/0255767 A1 9/2015 Aetukuri et al.
2015/0259220 A1 9/2015 Rosocha et al.
2015/0270106 A1 9/2015 Kobayashi et al.
2015/0274569 A1 10/2015 Boughton
2015/0333307 A1 11/2015 Thokchom et al.
2015/0342491 A1 12/2015 Marecki et al.
2015/0351652 A1 12/2015 Marecki et al.
2016/0028084 A1 1/2016 Lee et al.
2016/0028088 A1 1/2016 Romeo et al.
2016/0030359 A1 2/2016 Ma et al.
2016/0045841 A1 2/2016 Kaplan et al.
2016/0152480 A1 6/2016 Jang et al.
2016/0156031 A1 6/2016 Kim et al.
2016/0172163 A1 6/2016 Kaneko et al.
2016/0175929 A1 6/2016 Colin et al.
2016/0189933 A1 6/2016 Kobayashi et al.
2016/0197341 A1 7/2016 Lu et al.
2016/0254540 A1 9/2016 Lee et al.
2016/0284519 A1 9/2016 Kobayashi et al.
2016/0285090 A1 9/2016 Ozkan et al.
2016/0287113 A1 10/2016 Hebert et al.
2016/0308244 A1 10/2016 Badding et al.
2016/0332232 A1 11/2016 Forbes et al.
2016/0351910 A1 12/2016 Albano et al.
2016/0358757 A1 12/2016 Ikeda et al.
2017/0009328 A1 1/2017 Germann et al.
2017/0070180 A1 3/2017 Mills
2017/0101584 A1 4/2017 Skoptsov et al.
2017/0113935 A1 4/2017 Pennington et al.
2017/0120339 A1 5/2017 Aslund
2017/0125842 A1 5/2017 Meguro et al.
2017/0151609 A1 6/2017 Elsen et al.
2017/0176977 A1 6/2017 Huang et al.
2017/0179477 A1 6/2017 Walters et al.
2017/0209922 A1 7/2017 Kato et al.
2017/0320744 A1 11/2017 Haon et al.
2017/0338464 A1 11/2017 Fasching et al.
2017/0368604 A1 12/2017 Wilkinson
2017/0373344 A1 12/2017 Hadidi et al.
2018/0022928 A1 1/2018 Blush
2018/0025794 A1 1/2018 Lahoda et al.
2018/0083264 A1 3/2018 Soppe
2018/0104745 A1 4/2018 L'Esperance et al.
2018/0114677 A1 4/2018 Komatsu et al.
2018/0123121 A1 5/2018 Buchkremer et al.
2018/0130638 A1 5/2018 Ahmad et al.
2018/0134629 A1 5/2018 Kolios et al.
2018/0138018 A1 5/2018 Voronin et al.
2018/0159178 A1 6/2018 Weisenstein et al.
2018/0169763 A1 6/2018 Dorval et al.
2018/0214956 A1 8/2018 Larouche et al.
2018/0218883 A1 8/2018 Iwao
2018/0241956 A1 8/2018 Suzuki
2018/0248175 A1 8/2018 Ghezelbash et al.
2018/0277826 A1 9/2018 Gayden et al.
2018/0277849 A1 9/2018 Gayden
2018/0294143 A1 10/2018 Chua et al.
2018/0297122 A1* 10/2018 Hadidi ..... H05H 1/42
2018/0346344 A1 12/2018 Chen et al.
2018/0353643 A1 12/2018 Ma et al.
2018/0363104 A1 12/2018 Fujieda et al.
2018/0366707 A1 12/2018 Johnson et al.
2018/0375149 A1 12/2018 Beck et al.
2019/0001416 A1 1/2019 Larouche et al.
2019/0002353 A1 1/2019 Eckel et al.
2019/0061005 A1 2/2019 Kelkar
2019/0069944 A1 3/2019 Fischer
2019/0084290 A1 3/2019 Stoyanov et al.
2019/0088993 A1 3/2019 Ohta
2019/0109317 A1 4/2019 Zhou et al.
2019/0125842 A1 5/2019 Grabowski
2019/0127835 A1 5/2019 Yang et al.
2019/0157045 A1 5/2019 Meloni
2019/0160528 A1 5/2019 Mcgee et al.
2019/0165413 A1 5/2019 Furusawa
2019/0173130 A1 6/2019 Schuhmacher et al.
2019/0193151 A1 6/2019 Okumura et al.
2019/0218650 A1 7/2019 Subramanian et al.
2019/0271068 A1 9/2019 Sungail et al.
2019/0292441 A1 9/2019 Hill et al.
2019/0334206 A1 10/2019 Sastry et al.
2019/0341650 A9 11/2019 Lanning et al.
2019/0348202 A1 11/2019 Sachdev et al.
2019/0362936 A1 11/2019 Van Den Berg et al.
2019/0389734 A1 12/2019 Dietz et al.
2020/0028164 A1 1/2020 Ay et al.
2020/0067128 A1 2/2020 Chmiola et al.
2020/0136176 A1 4/2020 Chen
2020/0149146 A1 5/2020 Chen et al.
2020/0153037 A1 5/2020 Renna et al.
2020/0187607 A1 6/2020 Law
2020/0198977 A1 6/2020 Hof et al.
2020/0203706 A1 6/2020 Holman et al.
2020/0207668 A1 7/2020 Cavalli et al.
2020/0215607 A1 7/2020 Miko et al.
2020/0220222 A1 7/2020 Watarai et al.
2020/0223704 A1 7/2020 Neale et al.
2020/0227728 A1 7/2020 Huang et al.
2020/0254432 A1 8/2020 Shirman et al.
2020/0263274 A1 8/2020 Takizawa et al.
2020/0276638 A1 9/2020 King et al.
2020/0288561 A1 9/2020 Huh
2020/0314991 A1 10/2020 Duanmu et al.
2020/0335754 A1 10/2020 Ramasubramanian et al.
2020/0335781 A1 10/2020 Oshita et al.
2020/0350565 A1 11/2020 Oshita et al.
2020/0358093 A1 11/2020 Oshita et al.
2020/0358096 A1 11/2020 Paulsen et al.
2020/0381217 A1 12/2020 Kraus et al.
2020/0388857 A1 12/2020 Sunkara et al.
2020/0391295 A1 12/2020 Dorval et al.
2020/0395607 A1 12/2020 Tzeng
2020/0403236 A1 12/2020 Colwell
2020/0407858 A1 12/2020 Sano et al.
2021/0002759 A1 1/2021 Zhang et al.
2021/0024358 A1 1/2021 Chae et al.
2021/0024423 A1 1/2021 Nakamura et al.
2021/0032552 A1 2/2021 Mooney

(56) References Cited

U.S. PATENT DOCUMENTS

| | | | |
|---|---|---|---|
| 2021/0047186 | A1 | 2/2021 | Ifuku et al. |
| 2021/0057191 | A1 | 2/2021 | Stowell et al. |
| 2021/0075000 | A1 | 3/2021 | Holman et al. |
| 2021/0085468 | A1 | 3/2021 | Ryd et al. |
| 2021/0087404 | A1 | 3/2021 | Watanabe et al. |
| 2021/0098826 | A1 | 4/2021 | Chung et al. |
| 2021/0139331 | A1 | 5/2021 | Kang et al. |
| 2021/0187614 | A1 | 6/2021 | Tsubota et al. |
| 2021/0194045 | A1 | 6/2021 | Beck et al. |
| 2021/0226195 | A1 | 7/2021 | Stowell et al. |
| 2021/0226302 | A1 | 7/2021 | Lanning et al. |
| 2021/0229061 | A1 | 7/2021 | Stowell et al. |
| 2021/0253430 | A1 | 8/2021 | Zaplotnik et al. |
| 2021/0273217 | A1 | 9/2021 | Park et al. |
| 2021/0273292 | A1 | 9/2021 | Yun et al. |
| 2021/0276094 | A1 | 9/2021 | Sobu et al. |
| 2021/0296731 | A1 | 9/2021 | Wrobel et al. |
| 2021/0310110 | A1 | 10/2021 | Stowell et al. |
| 2021/0339313 | A1 | 11/2021 | Motchenbacher et al. |
| 2021/0344059 | A1 | 11/2021 | Ekman et al. |
| 2021/0367264 | A1 | 11/2021 | Hadidi et al. |
| 2022/0041457 | A1 | 2/2022 | Pullen et al. |
| 2022/0063012 | A1 | 3/2022 | Murata et al. |
| 2022/0119290 | A1 | 4/2022 | Fraser et al. |
| 2022/0127145 | A1 | 4/2022 | Ding et al. |
| 2022/0134430 | A1 | 5/2022 | Larouche et al. |
| 2022/0143693 | A1 | 5/2022 | Larouche et al. |
| 2022/0209298 | A1 | 6/2022 | Kim et al. |
| 2022/0223379 | A1 | 7/2022 | Holman et al. |
| 2022/0228288 | A1 | 7/2022 | Holman et al. |
| 2022/0267216 | A1 | 8/2022 | Holman et al. |
| 2022/0314325 | A1 | 10/2022 | Badwe |
| 2022/0324022 | A1 | 10/2022 | Badwe |
| 2022/0344707 | A1 | 10/2022 | Yoshioka et al. |
| 2022/0352548 | A1 | 11/2022 | Yoshioka et al. |
| 2022/0352549 | A1 | 11/2022 | Kim et al. |
| 2023/0001375 | A1 | 1/2023 | Kozlowski et al. |
| 2023/0001376 | A1 | 1/2023 | Kozlowski et al. |
| 2023/0025008 | A1 | 1/2023 | Lee et al. |
| 2023/0032362 | A1 | 2/2023 | Holman et al. |
| 2023/0046882 | A1 | 2/2023 | Anderson et al. |
| 2023/0100863 | A1 | 3/2023 | Lianto et al. |
| 2023/0143022 | A1 | 5/2023 | Mills |
| 2023/0144075 | A1 | 5/2023 | Badwe et al. |
| 2023/0211407 | A1 | 7/2023 | Hadidi |
| 2023/0219134 | A1 | 7/2023 | Houshmand et al. |
| 2023/0245896 | A1 | 8/2023 | Gupta et al. |
| 2023/0247751 | A1 | 8/2023 | Kozlowski et al. |
| 2023/0298885 | A1 | 9/2023 | Borude et al. |
| 2023/0330747 | A1 | 10/2023 | Barnes et al. |
| 2023/0330748 | A1 | 10/2023 | Badwe et al. |
| 2023/0352196 | A1 | 11/2023 | Ishikawa |
| 2023/0377848 | A1 | 11/2023 | Holman et al. |
| 2023/0395889 | A1 | 12/2023 | Yang et al. |
| 2023/0411123 | A1 | 12/2023 | Kozlowski et al. |
| 2024/0017322 | A1 | 1/2024 | Badwe et al. |
| 2024/0057245 | A1 | 2/2024 | Kozlowski et al. |
| 2024/0071725 | A1 | 2/2024 | Kozlowsk et al. |
| 2024/0088369 | A1 | 3/2024 | Holman et al. |
| 2024/0088467 | A1 | 3/2024 | Liao et al. |
| 2024/0326128 | A1 | 10/2024 | Hadidi et al. |
| 2024/0367139 | A1 | 11/2024 | Wrobel et al. |
| 2024/0383036 | A1 | 11/2024 | Larouche et al. |
| 2025/0002362 | A1 | 1/2025 | Pullen et al. |
| 2025/0014869 | A1 | 1/2025 | Kozlowski et al. |
| 2025/0031295 | A1 | 1/2025 | Shang et al. |
| 2026/0015760 | A1 | 1/2026 | Holman et al. |
| 2026/0102821 | A1 | 4/2026 | Barnes et al. |

FOREIGN PATENT DOCUMENTS

| | | | |
|---|---|---|---|
| CA | 2947531 | A1 | 11/2015 |
| CN | 1128732 | A | 8/1996 |
| CN | 1188073 | A | 7/1998 |
| CN | 1653869 | A | 8/2005 |
| CN | 1675785 | A | 9/2005 |
| CN | 1785500 | A | 6/2006 |
| CN | 1951861 | A | 4/2007 |
| CN | 1967911 | A | 5/2007 |
| CN | 101191204 | A | 6/2008 |
| CN | 101391307 | A | 3/2009 |
| CN | 101728509 | A | 6/2010 |
| CN | 101804962 | A | 8/2010 |
| CN | 101716686 | B | 2/2011 |
| CN | 102179521 | A | 9/2011 |
| CN | 102328961 | A | 1/2012 |
| CN | 102394290 | A | 3/2012 |
| CN | 102412377 | A | 4/2012 |
| CN | 102427130 | A | 4/2012 |
| CN | 102021355 | B | 7/2012 |
| CN | 102664273 | A | 9/2012 |
| CN | 102723502 | A | 10/2012 |
| CN | 102867940 | A | 1/2013 |
| CN | 102983312 | A | 3/2013 |
| CN | 103121105 | A | 5/2013 |
| CN | 103359713 | A | 10/2013 |
| CN | 103402921 | A | 11/2013 |
| CN | 102554242 | B | 12/2013 |
| CN | 103456926 | A | 12/2013 |
| CN | 103682372 | A | 3/2014 |
| CN | 103682383 | A | 3/2014 |
| CN | 103700815 | A | 4/2014 |
| CN | 103874538 | A | 6/2014 |
| CN | 103936096 | A | 7/2014 |
| CN | 103956520 | A | 7/2014 |
| CN | 104022284 | A | 9/2014 |
| CN | 104064736 | A | 9/2014 |
| CN | 104084592 | A | 10/2014 |
| CN | 104209526 | A | 12/2014 |
| CN | 104218213 | A | 12/2014 |
| CN | 204156003 | U | 2/2015 |
| CN | 104485452 | A | 4/2015 |
| CN | 104752734 | A | 7/2015 |
| CN | 104772473 | A | 7/2015 |
| CN | 103515590 | B | 9/2015 |
| CN | 105514373 | A | 4/2016 |
| CN | 105642879 | A | 6/2016 |
| CN | 106001597 | A | 10/2016 |
| CN | 106044777 | A | 10/2016 |
| CN | 106159316 | A | 11/2016 |
| CN | 106216703 | A | 12/2016 |
| CN | 106450146 | A | 2/2017 |
| CN | 106493350 | A | 3/2017 |
| CN | 206040854 | U | 3/2017 |
| CN | 106684387 | A | 5/2017 |
| CN | 106756417 | A | 5/2017 |
| CN | 106784692 | A | 5/2017 |
| CN | 106830019 | A | 6/2017 |
| CN | 107093732 | A | 8/2017 |
| CN | 107170973 | A | 9/2017 |
| CN | 107431196 | A | 12/2017 |
| CN | 107541633 | A | 1/2018 |
| CN | 107579241 | A | 1/2018 |
| CN | 107931622 | A | 4/2018 |
| CN | 108134104 | A | 6/2018 |
| CN | 108145170 | A | 6/2018 |
| CN | 108199107 | A | 6/2018 |
| CN | 108217612 | A | 6/2018 |
| CN | 108336442 | A | 7/2018 |
| CN | 108620597 | A | 10/2018 |
| CN | 108649190 | A | 10/2018 |
| CN | 108666563 | A | 10/2018 |
| CN | 108672709 | A | 10/2018 |
| CN | 108878862 | A | 11/2018 |
| CN | 108907210 | A | 11/2018 |
| CN | 108933239 | A | 12/2018 |
| CN | 108963239 | A | 12/2018 |
| CN | 109167070 | A | 1/2019 |
| CN | 109301212 | A | 2/2019 |
| CN | 109616622 | A | 4/2019 |
| CN | 109692965 | A | 4/2019 |
| CN | 109742320 | A | 5/2019 |
| CN | 109808049 | A | 5/2019 |
| CN | 109888233 | A | 6/2019 |

(56) References Cited

FOREIGN PATENT DOCUMENTS

| | | | |
|---|---|---|---|
| CN | 110117020 | A | 8/2019 |
| CN | 110153434 | A | 8/2019 |
| CN | 110213897 | A | 9/2019 |
| CN | 110218897 | A | 9/2019 |
| CN | 110299516 | A | 10/2019 |
| CN | 110790263 | A | 2/2020 |
| CN | 110993908 | A | 4/2020 |
| CN | 110997760 | A | 4/2020 |
| CN | 111099577 | A | 5/2020 |
| CN | 111342163 | A | 6/2020 |
| CN | 111370751 | A | 7/2020 |
| CN | 111403701 | A | 7/2020 |
| CN | 111446426 | A | 7/2020 |
| CN | 111515391 | A | 8/2020 |
| CN | 111755733 | A | 10/2020 |
| CN | 111970807 | A | 11/2020 |
| CN | 112259740 | A | 1/2021 |
| CN | 112331947 | A | 2/2021 |
| CN | 112397706 | A | 2/2021 |
| CN | 112421006 | A | 2/2021 |
| CN | 112421048 | A | 2/2021 |
| CN | 112447977 | A | 3/2021 |
| CN | 112768709 | A | 5/2021 |
| CN | 112768710 | A | 5/2021 |
| CN | 112768711 | A | 5/2021 |
| CN | 112864453 | A | 5/2021 |
| CN | 113097487 | A | 7/2021 |
| CN | 113104838 | A | 7/2021 |
| CN | 113764688 | A | 12/2021 |
| CN | 113871581 | A | 12/2021 |
| CN | 114388822 | A | 4/2022 |
| CN | 114408899 | A | 4/2022 |
| CN | 114744315 | A | 7/2022 |
| CN | 114824297 | A | 7/2022 |
| CN | 115394976 | A | 11/2022 |
| DE | 10335355 | A1 | 11/2004 |
| DE | 102006025124 | A1 | 12/2006 |
| DE | 102009033251 | A1 | 9/2010 |
| DE | 202011100570 | U1 | 7/2011 |
| DE | 102010006440 | A1 | 8/2011 |
| DE | 102011109137 | A1 | 2/2013 |
| DE | 102013008025 | A1 | 11/2014 |
| DE | 102018132896 | A1 | 6/2020 |
| EP | 0256233 | A2 | 2/1988 |
| EP | 0732761 | A2 | 9/1996 |
| EP | 1769554 | A2 | 4/2007 |
| EP | 1991388 | A2 | 11/2008 |
| EP | 2292557 | A1 | 3/2011 |
| EP | 2626936 | A1 | 8/2013 |
| EP | 2976198 | A1 | 1/2016 |
| EP | 3018099 | A1 | 5/2016 |
| EP | 3143838 | A1 | 3/2017 |
| EP | 3368238 | A1 | 9/2018 |
| EP | 3474978 | A1 | 5/2019 |
| EP | 4050974 | A1 | 8/2022 |
| FR | 2525122 | A1 | 10/1983 |
| FR | 2591412 | A1 | 6/1987 |
| GB | 2595745 | A | 12/2021 |
| GB | 2620597 | A | 1/2024 |
| IN | 202011017775 | | 10/2021 |
| JP | 56-155639 | A | 12/1981 |
| JP | 58-069713 | A | 4/1983 |
| JP | 63-243212 | A | 10/1988 |
| JP | 10-172564 | A | 6/1998 |
| JP | 10-296446 | A | 11/1998 |
| JP | 11-064556 | A | 3/1999 |
| JP | 2001-064703 | A | 3/2001 |
| JP | 2001-504753 | A | 4/2001 |
| JP | 2001-348296 | A | 12/2001 |
| JP | 2002-121607 | A | 4/2002 |
| JP | 2002-249836 | A | 9/2002 |
| JP | 2002-332531 | A | 11/2002 |
| JP | 2003-049201 | A | 2/2003 |
| JP | 2003-109589 | A | 4/2003 |
| JP | 2004-034014 | A | 2/2004 |
| JP | 2004-505761 | A | 2/2004 |
| JP | 2004-193115 | A | 7/2004 |
| JP | 2004-232084 | A | 8/2004 |
| JP | 2004-311297 | A | 11/2004 |
| JP | 2004-340414 | A | 12/2004 |
| JP | 2004-362895 | A | 12/2004 |
| JP | 2005-015282 | A | 1/2005 |
| JP | 2005-072015 | A | 3/2005 |
| JP | 2005-076052 | A | 3/2005 |
| JP | 2005-135755 | A | 5/2005 |
| JP | 2005-187295 | A | 7/2005 |
| JP | 2005-222956 | A | 8/2005 |
| JP | 2005-272284 | A | 10/2005 |
| JP | 2006-040722 | A | 2/2006 |
| JP | 2007-113120 | A | 5/2007 |
| JP | 2007-138287 | A | 6/2007 |
| JP | 2007-149513 | A | 6/2007 |
| JP | 2007-238402 | A | 9/2007 |
| JP | 2008-230905 | A | 10/2008 |
| JP | 2008-243447 | A | 10/2008 |
| JP | 2009-021214 | A | 1/2009 |
| JP | 2009-187754 | A | 8/2009 |
| JP | 2010-024506 | A | 2/2010 |
| JP | 2010-097914 | A | 4/2010 |
| JP | 2010-135336 | A | 6/2010 |
| JP | 2011-108406 | A | 6/2011 |
| JP | 2011-222323 | A | 11/2011 |
| JP | 2011-258348 | A | 12/2011 |
| JP | 2012-046393 | A | 3/2012 |
| JP | 2012-151052 | A | 8/2012 |
| JP | 2012-234788 | A | 11/2012 |
| JP | 2013-062242 | A | 4/2013 |
| JP | 2013-063539 | A | 4/2013 |
| JP | 2013-069602 | A | 4/2013 |
| JP | 2013-076130 | A | 4/2013 |
| JP | 2013-545228 | A | 12/2013 |
| JP | 2014-047117 | A | 3/2014 |
| JP | 2014-070005 | A | 4/2014 |
| JP | 2014-156365 | A | 8/2014 |
| JP | 2014-172812 | A | 9/2014 |
| JP | 2015-048269 | A | 3/2015 |
| JP | 2015-122218 | A | 7/2015 |
| JP | 2016-029193 | A | 3/2016 |
| JP | 2016-047961 | A | 4/2016 |
| JP | 2016-521198 | A | 7/2016 |
| JP | 2016-162672 | A | 9/2016 |
| JP | 2016-532773 | A | 10/2016 |
| JP | 6103499 | B2 | 3/2017 |
| JP | 2017-524628 | A | 8/2017 |
| JP | 2018-502029 | A | 1/2018 |
| JP | 2018-141762 | A | 9/2018 |
| JP | 2018-528328 | A | 9/2018 |
| JP | 2018-190563 | A | 11/2018 |
| JP | 2019-500503 | A | 1/2019 |
| JP | 2019-055898 | A | 4/2019 |
| JP | 2019-516020 | A | 6/2019 |
| JP | 2019-112699 | A | 7/2019 |
| JP | 2019-118882 | A | 7/2019 |
| JP | 2019-520894 | A | 7/2019 |
| JP | 2020-507193 | A | 3/2020 |
| JP | 2020-121898 | A | 8/2020 |
| JP | 2021-061089 | A | 4/2021 |
| JP | 2021-061090 | A | 4/2021 |
| JP | 2021-116191 | A | 8/2021 |
| JP | 2022-514676 | A | 2/2022 |
| JP | 2022-530649 | A | 6/2022 |
| KR | 10-0582507 | B1 | 5/2006 |
| KR | 10-0631169 | B1 | 10/2006 |
| KR | 10-0681169 | B1 | 2/2007 |
| KR | 10-2007-0076686 | A | 7/2007 |
| KR | 10-0792152 | B1 | 1/2008 |
| KR | 10-0793162 | B1 | 1/2008 |
| KR | 10-0793163 | B1 | 1/2008 |
| KR | 10-0839372 | B1 | 6/2008 |
| KR | 10-2009-0070140 | A | 7/2009 |
| KR | 10-1133094 | B1 | 4/2012 |
| KR | 10-2013-0063718 | A | 6/2013 |
| KR | 10-2014-0001813 | U | 3/2014 |
| KR | 10-2014-0123759 | A | 10/2014 |

(56) References Cited

FOREIGN PATENT DOCUMENTS

| | | | |
|---|---|---|---|
| KR | 10-2014-0130943 | A | 11/2014 |
| KR | 10-2015-0027042 | A | 3/2015 |
| KR | 10-1504247 | B1 | 3/2015 |
| KR | 10-1518234 | B1 | 5/2015 |
| KR | 10-2015-0109914 | A | 10/2015 |
| KR | 10-1574754 | B1 | 12/2015 |
| KR | 10-2016-0063057 | A | 6/2016 |
| KR | 10-1684219 | B1 | 12/2016 |
| KR | 10-2017-0003550 | A | 1/2017 |
| KR | 10-1708333 | B1 | 2/2017 |
| KR | 10-2017-0039922 | A | 4/2017 |
| KR | 10-2017-0045181 | A | 4/2017 |
| KR | 10-1789191 | B1 | 10/2017 |
| KR | 10-2018-0001799 | A | 1/2018 |
| KR | 10-1829935 | B1 | 2/2018 |
| KR | 10-2018-0035750 | A | 4/2018 |
| KR | 10-2018-0080315 | A | 7/2018 |
| KR | 10-1907912 | B1 | 10/2018 |
| KR | 10-1907916 | B1 | 10/2018 |
| KR | 10-1923466 | B1 | 11/2018 |
| KR | 10-2044380 | B1 | 11/2019 |
| KR | 10-2101006 | B1 | 4/2020 |
| KR | 10-2111622 | B1 | 5/2020 |
| KR | 10-2124946 | B1 | 6/2020 |
| KR | 10-2020-0082581 | A | 7/2020 |
| KR | 10-2020-0131751 | A | 11/2020 |
| KR | 10-2021-0057253 | A | 5/2021 |
| KR | 10-2021-0122035 | A | 10/2021 |
| KR | 10-2359101 | B1 | 2/2022 |
| KR | 10-2022-0042750 | A | 4/2022 |
| KR | 10-2022-0044062 | A | 4/2022 |
| KR | 10-2421156 | B1 | 7/2022 |
| RU | 2252817 | C1 | 5/2005 |
| RU | 2631692 | C1 | 9/2017 |
| RU | 2744449 | C1 | 3/2021 |
| TW | 521539 | B | 2/2003 |
| TW | 200630421 | A | 9/2006 |
| TW | M303584 | U | 12/2006 |
| TW | 200737342 | A | 10/2007 |
| TW | 200823313 | A | 6/2008 |
| TW | 200936775 | A | 9/2009 |
| TW | I329143 | B | 8/2010 |
| TW | 201112481 | A | 4/2011 |
| TW | 201225389 | A | 6/2012 |
| TW | 201310758 | A | 3/2013 |
| TW | 201411922 | A | 3/2014 |
| TW | I593484 | B | 8/2017 |
| TW | 201908504 | A | 3/2019 |
| TW | 202002723 | A | 1/2020 |
| TW | 202033297 | A | 9/2020 |
| WO | 03/77333 | A1 | 9/2003 |
| WO | 2004/054017 | A1 | 6/2004 |
| WO | 2004/089821 | A1 | 10/2004 |
| WO | 2005/033007 | A1 | 4/2005 |
| WO | 2005/039752 | A1 | 5/2005 |
| WO | 2005/117176 | A2 | 12/2005 |
| WO | 2006/100837 | A1 | 9/2006 |
| WO | 2008/152638 | A2 | 12/2008 |
| WO | 2010/095726 | A1 | 8/2010 |
| WO | 2011/082596 | A1 | 7/2011 |
| WO | 2011/090779 | A2 | 7/2011 |
| WO | 2012/023858 | A1 | 2/2012 |
| WO | 2012/054766 | A2 | 4/2012 |
| WO | 2012/114108 | A1 | 8/2012 |
| WO | 2012/144424 | A1 | 10/2012 |
| WO | 2012/162743 | A1 | 12/2012 |
| WO | 2013/017217 | A1 | 2/2013 |
| WO | 2013/142287 | A1 | 9/2013 |
| WO | 2014/011239 | A2 | 1/2014 |
| WO | 2014/110604 | A2 | 7/2014 |
| WO | 2014/153318 | A1 | 9/2014 |
| WO | 2015/064633 | A1 | 5/2015 |
| WO | 2015/141947 | A1 | 9/2015 |
| WO | 2015/174949 | A1 | 11/2015 |
| WO | 2015/187389 | A2 | 12/2015 |
| WO | 2016/048862 | A1 | 3/2016 |
| WO | 2016/071462 | A1 | 5/2016 |
| WO | 2016/082120 | A1 | 6/2016 |
| WO | 2016/091957 | A1 | 6/2016 |
| WO | 2016/178321 | A1 | 11/2016 |
| WO | 2017/070779 | A1 | 5/2017 |
| WO | 2017/074081 | A1 | 5/2017 |
| WO | 2017/074084 | A1 | 5/2017 |
| WO | 2017/080978 | A1 | 5/2017 |
| WO | 2017/091543 | A1 | 6/2017 |
| WO | 2017/106601 | A8 | 7/2017 |
| WO | 2017/118955 | A1 | 7/2017 |
| WO | 2017/130946 | A1 | 8/2017 |
| WO | 2017/158349 | A1 | 9/2017 |
| WO | 2017/177315 | A1 | 10/2017 |
| WO | 2017/178841 | A1 | 10/2017 |
| WO | 2017/223482 | A1 | 12/2017 |
| WO | 2018/133429 | A1 | 7/2018 |
| WO | 2018/141082 | A1 | 8/2018 |
| WO | 2018/145733 | A1 | 8/2018 |
| WO | 2018/145750 | A1 | 8/2018 |
| WO | 2019/045923 | A1 | 3/2019 |
| WO | 2019/052670 | A1 | 3/2019 |
| WO | 2019/066081 | A1 | 4/2019 |
| WO | 2019/095039 | A1 | 5/2019 |
| WO | 2019/124344 | A1 | 6/2019 |
| WO | 2019/139773 | A1 | 7/2019 |
| WO | 2019/178668 | A1 | 9/2019 |
| WO | 2019/243870 | A1 | 12/2019 |
| WO | 2019/246242 | A1 | 12/2019 |
| WO | 2019/246257 | A1 | 12/2019 |
| WO | 2020/009955 | A1 | 1/2020 |
| WO | 2020/013667 | A1 | 1/2020 |
| WO | 2020/041767 | A1 | 2/2020 |
| WO | 2020/041775 | A1 | 2/2020 |
| WO | 2020/091854 | A1 | 5/2020 |
| WO | 2020/132343 | A1 | 6/2020 |
| WO | 2020/223358 | A1 | 11/2020 |
| WO | 2020/223374 | A1 | 11/2020 |
| WO | 2021/015119 | A1 | 1/2021 |
| WO | 2021/029769 | A1 | 2/2021 |
| WO | 2021/046249 | A1 | 3/2021 |
| WO | 2021/085670 | A1 | 5/2021 |
| WO | 2021/115596 | A1 | 6/2021 |
| WO | 2021/118762 | A1 | 6/2021 |
| WO | 2021/127132 | A1 | 6/2021 |
| WO | 2021/142511 | A1 | 7/2021 |
| WO | 2021/159117 | A1 | 8/2021 |
| WO | 2021/191281 | A1 | 9/2021 |
| WO | 2021/193857 | A1 | 9/2021 |
| WO | 2021/245410 | A1 | 12/2021 |
| WO | 2021/245411 | A1 | 12/2021 |
| WO | 2021/263273 | A1 | 12/2021 |
| WO | 2022/005999 | A1 | 1/2022 |
| WO | 2022/032301 | A1 | 2/2022 |
| WO | 2022/043701 | A1 | 3/2022 |
| WO | 2022/043702 | A1 | 3/2022 |
| WO | 2022/043704 | A1 | 3/2022 |
| WO | 2022/043705 | A1 | 3/2022 |
| WO | 2022/067303 | A1 | 3/2022 |
| WO | 2022/075846 | A1 | 4/2022 |
| WO | 2022/107907 | A1 | 5/2022 |
| WO | 2022/133585 | A1 | 6/2022 |
| WO | 2022/136699 | A1 | 6/2022 |
| WO | 2022/150328 | A1 | 7/2022 |
| WO | 2022/150828 | A1 | 7/2022 |
| WO | 2023/022492 | A1 | 2/2023 |
| WO | 2023/038281 | A1 | 3/2023 |
| WO | 2024/013488 | A1 | 1/2024 |

OTHER PUBLICATIONS

Yang et al., "Preparation of Spherical Titanium Powders from Polygonal Titanium Hydride Powders by Radio Frequency Plasma Treatment" Materials Transactions, vol. 54, No. 12 (2013) pp. 2313-2316.

(56) References Cited

OTHER PUBLICATIONS

Zavilopulo, A. N., et al., "Ionization and Dissociative Ionization of Methane Molecules", Technical Physics, vol. 58, No. 9, 2013, pp. 1251-1257.
Zeng, X., et al., "Growth and morphology of carbon nanostructures by microwave-assisted pyrolysis of methane", Physica E., vol. 42, No. 8, 2010, pp. 2103-2108.
Zhang , K., Ph.D., "The Microstructure and Properties of Hipped Powder Ti Alloys", a thesis submitted to The University of Birmingham, College of Engineering and Physical Sciences, Apr. 2009, in 65 pages.
Zhang et al., Microstructures and properties of high-entropy alloys, Progress in Materials Science, vol. 61, 2013, pp. 1-93.
Zhang, H., et al., "Plasma activation of methane for hydrogen production in a N2 rotating gliding arc warm plasma: A chemical kinetics study", Chemical Engineering Journal, vol. 345, 2018, pp. 67-78.
Zhang, J., et al., "Flexible and ion-conducting membrane electrolytes for solid-state lithium batteries: Dispersion of garnet nanoparticles in insulating polyethylene oxide", Nano Energy, vol. 28, 2016, pp. 447-454.
Zhang, X. et al., "High thickness tungsten coating with low oxygen content prepared by air plasma spray", Cailiao Gongcheng. (2014) (5) pp. 23-28 (Year: 2014).
Zhang, Y. D. et al., "High-energy cathode materials for Li-ion batteries: A review of recent developments", Science China Technological Sciences, Sep. 2015, vol. 58(11), pp. 1809-1828.
Zhang, Y. S. et al., "Core-shell structured titanium-nitrogen alloys with high strength, high thermal stability and good plasticity", Scientific Reports, Jan. 2017, vol. 7, in 8 pages.
Zhong, R., et al., "Continuous preparation and formation mechanism of few-layer graphene by gliding arc plasma", Chemical Engineering Journal, vol. 387, 2020, 10 pages.
Zielinski, A et al., "Modeling and Analysis of a Dual-Channel Plasma Torch in Pulsed Mode Operation For Industrial Space, and Launch Applications", IEEE Transactions on Plasma Science, Jul. 2015, vol. 43(7), pp. 2201-2206.
Kerscher, F., et al., "Low-carbon hydrogen production via electron beam plasma methane pyrolysis: Techno-economic analysis and carbon footprint assessment", International Journal of Hydrogen Energy, vol. 46, Issue 38, 2021, pp. 19897-19912.
Kim, H., et al., "Three-Dimensional Porous Silicon Particles for Use in High-Performance Lithium Secondary Batteries", Angewandte Chemie International Edition, vol. 47, No. 2, Dec. 15, 2008, pp. 10151-10154.
Kim, K. S., et al., "Synthesis of single-walled carbon nanotubes by induction thermal plasma", Nano Research, 2009, vol. 2, No. 10, pp. 800-817.
Kim, S. et al., "Thermodynamic Evaluation of Oxygen Behavior in Ti Powder Deoxidized by Ca Reductant", Met. Mater. Int., 2016, vol. 22, pp. 658-662.
Ko, M. et al., "Challenges in Accommodating Volume Change of Si Anodes for Li-Ion Batteries", Chem Electro Chem, Aug. 2015, vol. 2, pp. 1645-1651. URL: https://doi.org/10.1002/celc.201500254.
Kotlyarov, V. I. et al, "Production of Spherical Powders on the Basis of Group IV Metals for Additive Manufacturing", Inorganic Materials: Applied Research, Pleiades Publishing, May 2017, vol. 8, No. 3, pp. 452-458.
Kumal, R. R., et al., "Microwave Plasma Formation of Nanographene and Graphitic Carbon Black", C—Journal of Carbon Research, 2020, vol. 6, No. 4, 10 pages.
Laine, R. M. et al., "Making nanosized oxide powders from precursors by flame spray pyrolysis", Key Engineering Materials, Jan. 1999, vol. 159-160, pp. 17-24.
Lee, D. H., et al., "Comparative Study of Methane Activation Process by Different Plasma Sources", Plasma Chem. Plasma Process., vol. 33, No. 4, 2013, pp. 647-661.
Lee, D. H., et al., "Mapping Plasma Chemistry in Hydrocarbon Fuel Processing Processes", Plasma Chem. Plasma Process., vol. 33, No. 1, 2013, pp. 249-269.
Li, L. et al., "Spheroidization of silica powders by radio frequency inductively coupled plasma with Ar-H2 and Ar-N2 as the sheath gases at atmospheric pressure", International Journal of Minerals, Metallurgy, and Materials, Sep. 2017, vol. 24(9), pp. 1067-1074.
Li, X. et al., "Mesoporous silicon sponge as an anti-pulverization structure for high-performance lithium-ion battery anodes", Nature Communications, Jul. 2014, vol. 5, Article No. 4105, in 7 pages. URL: httDs://doi.org/10.1038/ncomms5105.
Li, Z. et al., "Strong and Ductile Non-Equicaloric High-Entropy Alloys: Design, Processing, Microstructure, and Mechanical Properties", The Journal of the Minerals, Metals & Materials Society, Aug. 2017, vol. 69(1), pp. 2099-2106. URL: https://doi.org/10.1007/s11837-017-2540-2.
Lin et al., "A low temperature molten salt process for aluminothermic reduction of silicon oxides to crystalline Si for Li-ion batteries", Energy Environ. Sci., 2015, 8, 3187 (Year: 2015).
Lin, M., "Gas Quenching with Air Products' Rapid Gas Quenching Gas Mixture", Air Products, Dec. 31, 2007, in 4 pages. URL: hllps://www.airproducts.co.uk/-/media/airproducls/liles/en/330/330-07-085-us-gas-quenching-wilh-air-products-rapid-Jas-quenching-gas-mixture.pdf.
Liu, Y., et al., "Advances of microwave plasma-enhanced chemical vapor deposition in fabrication of carbon nanotubes: a review", J Mater Sci., vol. 55, 2021, pp. 12559-12583.
Liu, Z., et al., "Synthesis and characterization of LiNi1-x-yCoxMnyO2 as the cathode materials of secondary lithium batteries", Journal of Power Sources, vol. 81-82, Sep. 1999, pp. 416-419.
Majewksi, T., "Investigation of W—Re—Ni heavy alloys produced from plasma spheroidized powders", Solid State Phenomena, Mar. 2013, vol. 199, pp. 448-453.
Miller et al., "The reduction of silica with carbon and silicon carbide", Journal of the American Ceramic Society, 1978, 62 (Year: 1978).
Moisan, M. et al., "Waveguide-Based Single and Multiple Nozzle Plasma Torches: the Tiago Concept", Plasma Sources Science and Technology, Jun. 2001, vol. 10, pp. 387-394.
Moldover, M. R. et al., "Measurement of the Universal Gas Constant R Using a Spherical Acoustic Resonator", Physical Review Letters, Jan. 1988, vol. 60(4), pp. 249-252.
Muoio, C. et al., "Phase Homogeneity in Y2O3—MgO Nanocomposites Synthesized by Thermal Decomposition of Nitrate Precursors with Ammonium Acetate Additions" J. Am. Ceram. Soc., 94[12] 4207-4217, 2011.
Murugan et al. "Nanostructured a/β-tungsten by reduction of WO3 under microwave plasma", Int. Journal of Refractory Metals and Hard Materials 29 (2011) 128-133. (Year: 2011).
Nichols, F. A., "On the spheroidization of rod-shaped particles of finite length", Journal of Materials Science, Jun. 1976, vol. 11, pp. 1077-1082.
Nyutu, E. et al., "Ultrasonic Nozzle Spray in Situ Mixing and Microwave-Assisted Preparation of Nanocrystalline Spinel Metal Oxides: Nickel Ferrite and Zinc Aluminate", Journal of Physical Chemistry C, Feb. 1, 2008, vol. 112, No. 5, pp. 1407-1414.
Ohta, R. et al., "Effect of PS-PVD production throughput on Si nanoparticles for negative electrode of lithium ion batteries", Journal of Physics D: Applied Physics, Feb. 2018, vol. 51(1), in 7 pages.
Olsvik, O., et al, "Thermal Coupling of Methane—A Comparison Between Kinetic Model Data and Experimental Data", Thermochimica Acta., vol. 232, No. 1, 1994, pp. 155-169.
Or, T. et al., "Recycling of mixed cathode lithium-ion batteries for electric vehicles: Current status and future outlook", Carbon Energy, Jan. 2020, vol. 2, pp. 6-43. URL: https://doi.org/10.1002/cey2.29.
Park et al. "Preparation of spherical WTaMoNbV refractory high entropy alloy powder by inductively-coupled thermal plasma", Materials Letters 255 (2019) 126513 (Year: 2019).
Popescu et al.. "New TiZrNbTaFe high entropy alloy used for medical applications" IOP Conference Series: Materials Science and Engineering 400. Mod Tech 2018 (2018), 9 pages.
Pulsation Reactors—Thermal Processing for Extraordinary Material Properties, retrieved from https://www.ibu-tec.com/facilities/pulsation-reactors/, retrieved on Mar. 18, 2023, pp. 5.

(56) References Cited

OTHER PUBLICATIONS

Reig, L. et al., "Microstructure and Mechanical Behavior of Porous Ti—6Al—4V Processed by Spherical Powder Sintering", Materials, Oct. 23, 2013, vol. 6, pp. 4868-4878.
Sabat, K.C., "Hydrogen Plasma—Thermodynamics", Journal of Physics: Conference Series, 2019, International Conference on Applied Physics, Powder and Material Science, in 6 pages.
Sastry, S.M.L. et al., "Rapid Solidification Processing of Titanium Alloys", Journal of Metals (JOM), Sep. 1983, vol. 35, pp. 21-28.
Savage, S. J. et al., "Production of rapidly solidified metals and alloys", Journal of Metals (JOM), Apr. 1984, vol. 36, pp. 20-33.
Schmidt-Ott, K., "Plasma-Reduction: Its Potential for Use in the Conservation of Metals", Proceedings of Metal 2004, Oct. 2004, pp. 235-246.
Seehra, M. S., et al., "Correlation between X-ray diffraction and Raman spectra of 16 commercial graphene-based materials and their resulting classification", Carbon N Y., 2017, vol. 111, pp. 380-384.
Sheng, Y. et al., "Preparation of Micro-spherical Titanium Powder by RF Plasma", Rare Metal Materials and Engineering, Jun. 2013, vol. 42, No. 6, pp. 1291-1294.
Sheng, Y. et al., "Preparation of Spherical Tungsten Powder by RF Induction Plasma", Rare Metal Materials and Engineering, Nov. 2011, vol. 40, No. 11, pp. 2033-2037.
SK makes world's 1st NCM battery with 90% nickel, The Investor, available online <https://www.theinvestor.co.kr/view.php?ud=20200810000820>, dated Aug. 10, 2020, 2 pages.
Suryanarayana, C. et al., "Rapid solidification processing of titanium alloys", International Materials Reviews, 1991, vol. 36, pp. 85-123.
Suryanarayana, C., "Recent Developments in Mechanical Alloying", Reviews on Advanced Materials Science, Aug. 2008, vol. 18(3), pp. 203-211.
Tang, H. P. et al., "Effect of Powder Reuse Times on Additive Manufacturing of Ti—6Al—4V by Selective Electron Beam Melting", JOM, Mar. 2015, vol. 67, pp. 555-563.
Taylor, G., et al.; "Reduction of Metal Oxides by Hydrogen", 1930, vol. 52 (Year: 1930).
Thierry, "Hydrogen (H2) Plasma", Thierry Corp., retrieved from internet on Feb. 15, 2024, in 2 pages. URL: https://www.thierry-corp.com/plasma-knowledgebase/hydrogen-h2-plasma.
Van Laar, J. H. et al., "Spheroidization of Iron Powder in a Microwave Plasma Reactor", Journal of the Southern African Institute of Mining and Metallurgy, Oct. 2016, vol. 116, No. 10, pp. 941-946.
Veith, M. et al., "Low temperature synthesis of nanocrystalline Y3Al5012 (YAG) and Ce-doped Y3Al5012 via different sol-gel methods", J. Maler Chem, 1999, pp. 3069-3079.
Walter et al., "Microstructural and mechanical characterization of sol gel-derived Si—O—C glasses" Journal of the European Ceramic Society, vol. 22, Issue 13, Dec. 2002, pp. 2389-2400.
Wang, H., et al., "A detailed kinetic modeling study of aromatics formation in laminar premixed acetylene and ethylene flames" Combustion and Flame, vol. 110, No. 1-2, 1997, pp. 173-221.
Wang, J. et al., "Preparation of Spherical Tungsten and Titanium Powders by RF Induction Plasma Processing", Rare Metals, Jun. 2015 (published online May 31, 2014), vol. 34, No. 6, pp. 431-435.
"Build Boldly", Technology Demonstration, 6K Additive, [publication date unknown], in 11 pages.
"High-entropy alloy", Wikipedia, webpage last edited Dec. 29, 2022 (accessed Jan. 17, 2023), in 16 pages. URL: https://en.wikipedia.org/wiki/High-entropy_alloy.
6K, "6K Launches World's First Premium Metal Powders For Additive Manufacturing Derived From Sustainable Sources", Cision PR Newswire, Nov. 4, 2019, in 1 page. URL: https://www.prnewswire.com/news-releases/6k-launches-worlds-first-premium-metal-powders-for-additive-manufacturing-derived-from-sustainable-sources-300950791.html.
Ajayi, B. et al., "A rapid and scalable method for making mixed metal oxide alloys for enabling accelerated materials discovery", Journal of Materials Research, Jun. 2016, vol. 31, No. 11, pp. 1596-1607.
Ajayi, B. P. et al., "Atmospheric plasma spray pyrolysis of lithiated nickel-manganese-cobalt oxides for cathodes in lithium-ion batteries", Chemical Engineering Science, vol. 174, Sep. 14, 2017, pp. 302-310.
Ali, M. et al., Spray Flame Synthesis (SFS) of Lithium Lanthanum Zirconate (LLZO) Solid Electrolyte, Materials, vol. 14, No. 13, 2021, pp. 1-13.
Barbis et al., "Titanium powders from the hydride-dehydride process." Titanium Powder Metallurgy. Butterworth-Heinemann, 2015. pp. 101-116.
Bardos, L., et al., "Differences between microwave and RF activation of nitrogen for the PECVD process", J. Phys. D: Appl. Phys., vol. 15, 1982, pp. 79-82.
Bardos, L., et al., "Microwave Plasma Sources and Methods in Processing Technology", IEEE Press, 2022, 10 pages.
Bobzin, K. et al., "Modelling and Diagnostics of Multiple Cathodes Plasma Torch System for Plasma Spraying", Frontiers of Mechanical Engineering, Sep. 2011, vol. 6, pp. 324-331.
Bobzin, K. et al., "Numerical and Experimental Determination of Plasma Temperature during Air Plasma Spraying with a Multiple Cathodes Torch", Journal of Materials Processing Technology, Oct. 2011, vol. 211, pp. 1620-1628.
Boulos, M. I., "The inductively coupled radio frequency plasma." Journal of High Temperature Material Process, Jan. 1997, vol. 1, pp. 17-39.
Boulos, M., "Induction Plasma Processing of Materials for Powders, Coatings, and Near-Net-Shape Parts", Advanced Materials & Processes, Aug. 2011, pp. 52-53, in 3 pages.
Boulos, M., "Plasma power can make better powders", Metal Powder Report, May 2004, vol. 59(5), pp. 16-21.
Carreon, H. et al., "Study of Aging Effects in a Ti—6AL—4V alloy with Widmanslallen and Equiaxed Microstructures by Non-destructive Means", AIP Conference Proceedings 1581, 2014 (published online Feb. 17, 2015), pp. 739-745.
Chang, S. et al., "One-Step Fast Synthesis of Li4Ti5012 Particles Using an Atmospheric Pressure Plasma Jet", Journal of the American Ceramic Society, Dec. 26, 2013, vol. 97, No. 3, pp. 708-712.
Chau, J. L. K. et al. "Microwave Plasma Production of Metal Nanopowders," Jun. 12, 2014, Inorganics, vol. 2, pp. 278-290 (Year: 2014).
Chen, G. et al., "Spherical Ti—6Al—4V Powders Produced by Gas Atomization", Key Engineering Materials, vol. 704, Aug. 2016, pp. 287-292. URL: https://www.scientific.net/KEM.704.287.
Chen, Z., et al., "Advanced cathode materials for lithium-ion batteries", MRS Bulletin, vol. 36, No. 7, 2011, pp. 498-505.
Chikumba et al., "High Entropy Alloys: Development and Applications" 7th International Conference on Latest Trends in Engineering & Technology (ICLTET'2015) Nov. 26-27, 2015 Irene, Pretoria (South Africa).
Choi, S. I., et al., "Continuous process of carbon nanotubes synthesis by decomposition of methane using an arc-jet plasma", Thin Solid Films, 2006, vol. 506-507, 2006, pp. 244-249.
Coldwell, D. M. et al., "The reduction of SiO.sub.2 with Carbon in a Plasma", Journal of Electrochemical Society, Jan. 1977, vol. 124, pp. 1686-1689.
Collin, J. E., et al., "Ionization of methane and it's electronic energy levels", Canadian Journal of Chemistry, 2011, vol. 45, No. 16, pp. 1875-1882.
Dearmiti, C., "26. Functional Fillers for Plastics", in Applied Plastics Engineering Handbook—Processing and Materials, ed., Myer Kuiz, Elsevier, 2011, pp. 455-468.
Decker, J., et al., "Sample preparation protocols for realization of reproducible characterization of single-wall carbon nanotubes", Metrologia, 2009, vol. 46, No. 6, pp. 682-692.
Ding, F., et al., "Nucleation and Growth of Single-Walled Carbon Nanotubes: A Molecular Dynamics Study", J. Phys. Chem. B, vol. 108, 2004, pp. 17369-17377.

(56) References Cited

OTHER PUBLICATIONS

Ding, F., et al., "The Importance of Strong Carbon-Metal Adhesion for Catalytic Nucleation of Single-Walled Carbon Nanotubes", Nano Letters, 2008, vol. 8, No. 2, pp. 463-468.
Dolbec, R., "Recycling Spherical Powders", Presented at Titanium 2015, Orlando, FL, Oct. 2015, in 20 pages.
Dors, M., et al., "Chemical Kinetics of Methane Pyrolysis in Microwave Plasma at Atmospheric Pressure", Plasma Chem Plasma Process, 2013, vol. 34, No. 2, pp. 313-326.
Eremin, A., et al., "The Role of Methyl Radical in Soot Formation", Combustion Science and Technology, vol. 191, No. 12, 2008, pp. 2226-2242.
Finckle, J. R., et al., "Plasma Pyrolysis of Methane to Hydrogen and Carbon Black", Industrial Engineering and Chemical Research, 2002. vol. 41, No. 6, 2002, pp. 1425-1435.
Fu, D., et al., "Direct synthesis of Y-junction carbon nanotubes by microwave-assisted pyrolysis of methane", Materials Chemistry and Physics, vol. 118, vol. 2-3, 2009, pp. 501-505.
Fuchs, G.E. et al., "Microstructural evaluation of as-solidified and heat-treated y—TiAl based powders", Materials Science and Engineering, 1992, A152, pp. 277-282.
Gleiman, S. et al., "Melting and spheroidization of hexagonal boron nitride in a microwave-powered, atmospheric pressure nitrogen plasma", Journal of Materials Science, Aug. 2002, vol. 37(16), pp. 3429-3440.
Grace, J. et al., "Connecting particle sphericity and circularity", Particuology, vol. 54, 2021, pp. 1-4, ISSN 1674-2001, https://doi.org/10.1016/j.partic.2020.09.006. (Year: 2020).
Gradl, P. et al., "GRCop-42 Development and Hot-fire Testing Using Additive Manufacturing Powder Bed Fusion for Channel-Cooled Combustion Chambers", 55th AIAA/SAE/ASEE Joint Propulsion Conference 2019, Aug. 2019, pp. 1-26.
Haghighatpanah, S., et al., "Computational studies of catalyst-free single walled carbon nanotube growth", J Chem Phys, vol. 139, No. 5, 10 pages.
Haneklaus, N., et al., "Stop Smoking—Tube-In-Tube Helical System for Flameless Calcination of Minerals", Processes, vol. 5, No. 4, 2017, pp. 1-12.
He et al., "A precipitation-hardened high-entropy alloy with outstanding tensile properties" Acta Materialia 102, Jan. 2016, pp. 187-196.
Houmes et al., "Microwave Synthesis of Ternary Nitride Materials", Journal of Solid State Chemistry, vol. 130, Issue 2, May 1997, pp. 266-271.
Huo, H., et al., "Composite electrolytes of polyethylene oxides/garnets interfacially wetted by ionic liquid for room-temperature solid-state lithium battery", Journal of Power Sources, vol. 372, 2017, pp. 1-7.
International Preliminary Report on Patentability and Written Opinion, re PCT Application No. PCT/US2021/071967, mailed May 11, 2023.
International Search Report and Written Opinion, re PCT Application No. PCT/US2021 /071967, mailed Feb. 18, 2022.
Irle, S., et al., "Milestones in molecular dynamics simulations of single-walled carbon nanotube formation: A brief critical review", Nano Research, 2009, vol. 2, No. 10, 14 pages.
Ivasishin, et al., "Innovative Process for Manufacturing Hydrogenated Titanium Powder for Solid State Production of R/M Titanium Alloy Components" Titanium 2010, Oct. 3-6, 2010, 27 pages.
Jasek, O., et al., "Microwave plasma-based high temperature dehydrogenation of hydrocarbons and alcohols as a single route to highly efficient gas phase synthesis of freestanding graphene", Nanotechnology, 2021, vol. 32, 11 pages.
Jasinski, M., et al., "Atmospheric pressure microwave plasma source for hydrogen production", International Journal of Hydrogen Energy, vol. 38, Issue 26, 2013, pp. 11473-11483.
Jasinski, M., et al., "Hydrogen production via methane reforming using various microwave plasma sources", Chem. Listy, 2008, vol. 102, pp. s1332-s1337.
Jia, H. et al., "Hierarchical porous silicon structures with extraordinary mechanical strength as high-performance lithium-ion battery anodes", Nature Communications, Mar. 2020, vol. 11, in 9 pages. URL: https://doi.org/10.1038/s41467-020-15217-9.
Kassel, L. S., "The Thermal Decomposition of Methane", Journal of the American Chemical Society, vol. 54, No. 10, 1932, pp. 3949-3961.
Bell, T. "The properties and uses of silicon metal", ThoughtCo., Aug. 15, 2019, in 13 pages. URL: https://www.thoughtco.com/metal-profile-silicon-4019412.
Colombini, E., et al., "High entropy alloys obtained by field assisted powder metallurgy route: SPS and microwave heating", Materials Chemistry and Physics, vol. 210, May 1, 2018, pp. 78-86.
Czosnek, C., et al., "Preparation of silicon carbide SiC-based nanopowders by the aerosol-assisted synthesis and the DC thermal plasma synthesis methods", Materials Research Bulletin, vol. 63, Mar. 2015, pp. 164-172.
Fang, S., et al., "Microstructure and mechanical properties of twinned Al0.5CrFeNiCo0.3C0.2 high entropy alloy processed by mechanical alloying and spark plasma sintering", Materials & Design, vol. 54, 2014, pp. 973-979.
Huang, Q., et al., "The reactivity of charged positive Li1-n[NixMnyCoz]O2 electrodes with electrolyte at elevated temperatures using accelerating rate calorimetry", Journal of Power Sources, vol. 390, Apr. 2018, pp. 78-86.
Krivolapova, O. N., et al., "Application of microwave radiation for decrepitation of spodumene from the Kolmozerskoe deposit", Izvestiya. Non-ferrous Metallurgy, vol. 29, No. 6, 2023, 16 pages.
Lin, H., et al., "Synthesis of amorphous silicon carbide nanoparticles in a low temperature low pressure plasma reactor", Nanotechnology, vol. 19, No. 32, Jul. 2008,in 8 pages.
Nava-Avendano, J., et al., "Plasma processes in the preparation of lithium-ion battery electrodes and separators", Journal of Physics D: Applied Physics, vol. 50, No. 16, 2017, 23 pages.
Razaee, M., et al., "Microwave-assisted calcination of spodumene for efficient, low-cost and environmentally friendly extraction of lithium", Powder Technology, vol. 397, Jan. 2022, 8 pages.
Sun, S., et al., "Rapid degradation and efficient defluorination of perfluorooctanoic acid(PFOA) by microwave discharge plasma in liquid combined with catalytic ions Fe2+", Journal of Environmental Chemical Engineering, vol. 11, Apr. 2023, in 9 pages.
Sun, S., et al., "Efficient defluorination of PFOA by microwave discharge plasma in liquid: Influence of actual water environment factors", Journal of Water Process Engineering, vol. 55, Aug. 2023, in 8 pages.
Wang, Y., et al., "High-Voltage "Single-Crystal" Cathode Materials for Lithium-Ion Batteries", Energy & Fuels, vol. 35, No. 3, Jan. 14, 2021, 15 pages.
Yang, P., et al., "Electromagnetic wave absorption properties of mechanically alloyed FeCoNiCrAl high entropy alloy powders", Advanced Powder Technology, vol. 27, No. 4, 2016, pp. 1128-1133.
Zhao Jing et al., "Introduction to Materials Science," China Light Industry Press, 2nd edition, 1st printing, Jun. 2013, p. 61.
Zhu, H. et al., "Study on behaviors of tungsten powders in radio frequency thermal plasma", International Journal of Refractory Metals and Hard Materials, vol. 66, Aug. 2017, pp. 76-82.

* cited by examiner

SYSTEMS AND METHODS FOR SYNTHESIS OF SPHEROIDIZED METAL POWDERS

INCORPORATION BY REFERENCE TO ANY PRIORITY APPLICATIONS

This application is a divisional of U.S. patent application Ser. No. 17/451,716, filed Oct. 21, 2021, which claims the priority benefit under 35 U.S.C. § 119(e) of U.S. Provisional Application No. 63/108,118, filed Oct. 30, 2020, the entire disclosure of which is incorporated herein by reference. Any and all applications for which a foreign or domestic priority claim is identified in the Application Data Sheet as filed with the present application are hereby incorporated by reference under 37 CFR 1.57.

BACKGROUND

Field

Some embodiments of the present disclosure are directed to systems and methods for producing metal spherical or spheroidal powder products from feedstock materials.

Description

An important aspect of preparing some forms of industrial powders is the spheroidization process, which transforms irregularly shaped or angular powders produced by conventional crushing methods, into spherical low-porosity particles. Spherical powders are homogenous in shape, denser, less porous, have a high and consistent flowability, and high tap density. Such powders exhibit superior properties in applications such as injection molding, thermal spray coatings, and additive manufacturing, among others.

Creating spheroidal metallic powders, especially metallic powders containing materials such as titanium (Ti), can pose a number of challenges. Achieving the desired spheroidal shape, the desired level of porosity (e.g., no porosity to very porous), and the desired composition and microstructure can be difficult.

Titanium nitride powders are of particular interest. Titanium nitride has been used in a variety of applications, including in medical implants as a protective wear resistant coating. Many current orthopedic implants made from, for example, CoCr or titanium alloys (e.g., Ti-64), have poor wear resistance and require a titanium nitride coating to prevent eventual failure of the implant in the body. Titanium nitride is a ceramic with excellent wear and corrosion resistance and is compatible with human body. The coating is typically applied to implants by Chemical Vapor Deposition (CVD), where vapors of Ti are reacted with Nitrogen gas to form titanium nitride coating. This process forms a very thin, coherent layer of titanium nitride.

With the advent of additive manufacturing (AM), however, the design of implants has also evolved. It is now possible to design implants with internal cavities that reduce the weight of the implant and also provide a location for tissue growth inside the implant. However, with intricate internal cavities, coating a layer of titanium nitride evenly on the surfaces inside the implant has become challenging.

Thus, novel systems and methods of producing metal-containing spherical powders for use in additive manufacturing and other applications are needed.

SUMMARY

For purposes of this summary, certain aspects, advantages, and novel features of the invention are described herein. It is to be understood that not all such advantages necessarily may be achieved in accordance with any particular embodiment of the invention. Thus, for example, those skilled in the art will recognize that the invention may be embodied or carried out in a manner that achieves one advantage or group of advantages as taught herein without necessarily achieving other advantages as may be taught or suggested herein.

Some embodiments herein are directed to methods for manufacturing a spheroidized metal nitride powder, the method comprising: providing a metal powder as a feedstock to a microwave plasma torch; introducing the feedstock into a microwave plasma generated by the microwave plasma torch, the microwave plasma generated by subjecting a nitrogen-containing gas to microwaves from a microwave power source; and forming the spheroidized metal nitride powder, the spheroidized metal nitride powder formed by at least partially melting the feedstock and initiating a chemical reaction between the feedstock and the nitrogen-containing gas within the microwave plasma torch.

In some embodiments, the method further comprises selecting a desired porosity, composition, or microstructure of the spheroidized metal nitride powder, and wherein the spheroidized metal nitride powder comprises the desired porosity, composition, or microstructure. In some embodiments, the spheroidized metal nitride powder comprises a particle-size distribution between 15-106 microns. In some embodiments, the metal powder comprises titanium powder. In some embodiments, the titanium powder comprises commercially pure titanium (cpTi) powder. In some embodiments, the titanium powder comprises gas atomized titanium powder, hydride-dehydride (HDH) titanium powder, or hydrided titanium powder. In some embodiments, the nitrogen-containing gas comprises one or more of hydrogen, helium, neon, argon, krypton, or xenon. In some embodiments, the nitrogen-containing gas comprises nitrogen gas ($N_2$). In some embodiments, the spheroidized metal nitride powder comprises spheroidized titanium nitride powder. In some embodiments, the spheroidized titanium nitride powder comprises one or more of TiN, $Ti_2N$, or $TiN_2$ phases. In some embodiments, the stoichiometry of the spheroidized metal nitride powder is controlled by altering the molar concentration of nitrogen in the nitrogen-containing gas and/or a residence time of the feedstock in the microwave plasma. In some embodiments, the chemical reaction comprises: $2Ti+N_2 \rightarrow 2TiN$; or $4Ti+N_2 \rightarrow 2Ti_2N$. In some embodiments, the spheroidized metal nitride powder comprises one or more of oxygen, iron, and carbon.

Some embodiments herein are directed to methods of additive manufacturing, comprising using the spheroidized metal nitride powder synthesized using a method for manufacturing a spheroidized metal nitride powder, the method comprising: providing a metal powder as a feedstock to a microwave plasma torch; introducing the feedstock into a microwave plasma generated by the microwave plasma torch, the microwave plasma generated by subjecting a nitrogen-containing gas to microwaves from a microwave power source; and forming the spheroidized metal nitride powder, the spheroidized metal nitride powder formed by at least partially melting the feedstock and initiating a chemical reaction between the feedstock and the nitrogen-containing gas within the microwave plasma torch.

Some embodiments herein are directed to spheroidized metal nitride powders synthesized according to a method for manufacturing a spheroidized metal nitride powder, the method comprising: providing a metal powder as a feedstock to a microwave plasma torch; introducing the feedstock into a microwave plasma generated by the microwave plasma torch, the microwave plasma generated by subjecting a nitrogen-containing gas to microwaves from a microwave power source; and forming the spheroidized metal nitride powder, the spheroidized metal nitride powder formed by at least partially melting the feedstock and initiating a chemical reaction between the feedstock and the nitrogen-containing gas within the microwave plasma torch.

Some embodiments herein are directed to methods for manufacturing a spheroidized metal carbide powder, the method comprising: providing a metal powder as a feedstock to a microwave plasma torch; introducing the feedstock into a microwave plasma generated by the microwave plasma torch, the microwave plasma generated by subjecting a carbon-containing gas to microwaves from a microwave power source; and forming the spheroidized metal carbide powder, the spheroidized metal carbide powder formed by at least partially melting the feedstock and initiating a chemical reaction between the feedstock and carbon-containing gas within the microwave plasma torch, the spheroidized metal carbide powder comprising a particle-size between 15-106 microns.

In some embodiments, the metal powder comprises silicon, aluminum, titanium, tungsten, or powder. In some embodiments, the titanium powder comprises commercially pure titanium (cpTi) powder. In some embodiments, the titanium powder comprises gas atomized titanium powder, hydride-dehydride (HDH) titanium powder, or titanium hydride powder. In some embodiments, the carbon-containing gas comprises one or more of hydrogen, helium, neon, argon, krypton, or xenon. In some embodiments, the carbon-containing gas comprises hydrocarbon gas. In some embodiments, the stoichiometry of the spheroidized metal nitride powder is controlled by altering the amount of carbon in the carbon-containing gas or a residence time of the feedstock in the microwave plasma.

Some embodiments herein are directed to methods of additive manufacturing, comprising using the spheroidized metal carbide powder manufactured using the method for manufacturing a spheroidized metal carbide powder, the method comprising: providing a metal powder as a feedstock to a microwave plasma torch; introducing the feedstock into a microwave plasma generated by the microwave plasma torch, the microwave plasma generated by subjecting a carbon-containing gas to microwaves from a microwave power source; and forming the spheroidized metal carbide powder, the spheroidized metal carbide powder formed by at least partially melting the feedstock and initiating a chemical reaction between the feedstock and carbon-containing gas within the microwave plasma torch, the spheroidized metal carbide powder comprising a particle-size between 15-106 microns.

Some embodiments herein are directed to spheroidized metal carbide powders manufactured according to the methods for manufacturing a spheroidized metal carbide powder, the method comprising: providing a metal powder as a feedstock to a microwave plasma torch; introducing the feedstock into a microwave plasma generated by the microwave plasma torch, the microwave plasma generated by subjecting a carbon-containing gas to microwaves from a microwave power source; and forming the spheroidized metal carbide powder, the spheroidized metal carbide powder formed by at least partially melting the feedstock and initiating a chemical reaction between the feedstock and carbon-containing gas within the microwave plasma torch, the spheroidized metal carbide powder comprising a particle-size between 15-106 microns.

Some embodiments herein are directed to methods for manufacturing a spheroidized powder, the method comprising: providing a feedstock to a microwave plasma torch; introducing the feedstock into a microwave plasma generated by the microwave plasma torch, the microwave plasma generated by subjecting a reactive plasma gas to microwaves from a microwave power source; and forming the spheroidized powder, the spheroidized powder formed by at least partially melting the feedstock and initiating a chemical reaction between the feedstock and the reactive plasma gas within the microwave plasma torch. In some embodiments, the method further comprises selecting a desired porosity, composition, or microstructure of the spheroidized powder, and wherein the spheroidized powder comprises the desired porosity, composition, or microstructure. In some embodiments, the spheroidized powder comprises a particle-size distribution between 15-106 microns. In some embodiments, the feedstock comprises titanium powder. In some embodiments, the titanium powder comprises commercially pure titanium (cpTi) powder. In some embodiments, the titanium powder comprises gas atomized titanium powder, hydride-dehydride (HDH) titanium powder, or hydrided titanium powder. In some embodiments, the reactive plasma gas comprises nitrogen-containing gas, wherein the nitrogen-containing gas comprises one or more of hydrogen, helium, neon, argon, krypton, or xenon. In some embodiments, the reactive plasma gas comprises nitrogen gas ($N_2$). In some embodiments, the spheroidized powder comprises spheroidized titanium nitride powder. In some embodiments, the spheroidized titanium nitride powder comprises one or more of TiN, $Ti_2N$, or $TiN_2$ phases. In some embodiments, the chemical reaction comprises: $2Ti+N_2 \rightarrow 2TiN$; or $4Ti+N_2 \rightarrow 2Ti_2N$. Some embodiments herein are directed to a method of additive manufacturing, comprising using the spheroidized powder synthesized using the method for manufacturing a spheroidized powder.

Some embodiments herein are directed to spheroidized titanium nitride powders comprising: a plurality of titanium nitride particles exhibiting a substantially spherical shape, the plurality of titanium nitride particles comprising a particle-size distribution between 15-106 microns and the plurality of titanium nitride particles comprising at least one of the following phases: α-Ti, TiN, Ti2N, or TiN2.

In some embodiments, the spheroidized titanium nitride powder is synthesized by microwave plasma processing of a titanium feedstock. In some embodiments, the plurality of particles comprise a microstructure formed by reacting the titanium feedstock with a nitrogen-containing plasma gas. In some embodiments, the plurality of particles have a mean sphericity greater than 0.75 or 0.91. In some embodiments, the plurality of particles have a median sphericity greater than 0.75 or 0.91. In some embodiments, the plurality of particles comprise a titanium nitride shell formed with a cpTi core. In some embodiments, the plurality of particles comprise titanium nitride throughout the particles.

BRIEF DESCRIPTION OF THE DRAWINGS

The drawings are provided to illustrate example embodiments and are not intended to limit the scope of the disclosure. A better understanding of the systems and methods described herein will be appreciated upon reference to the following description in conjunction with the accompanying drawings, wherein.

DETAILED DESCRIPTION

Figure 1:
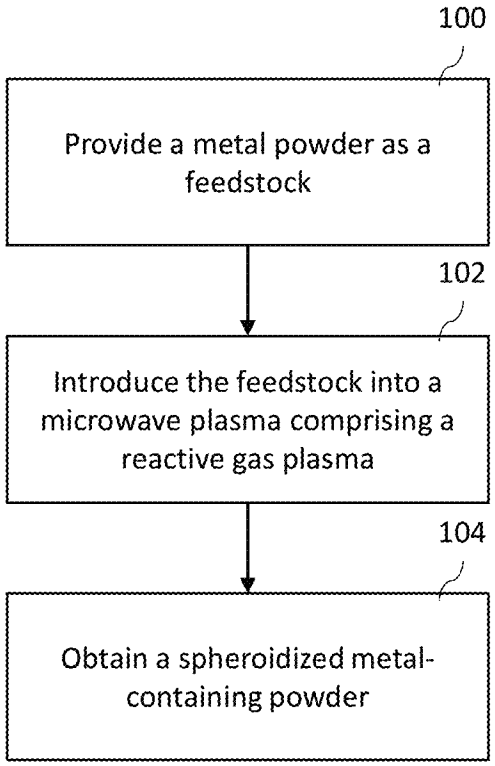
FIG. 1 illustrates an example flowchart of a process for producing a spheroidized metal-containing powder according to some embodiments described herein.

Although certain preferred embodiments and examples are disclosed below, inventive subject matter extends beyond the specifically disclosed embodiments to other alternative embodiments and/or uses and to modifications and equivalents thereof. Thus, the scope of the claims appended hereto is not limited by any of the particular embodiments described below. For example, in any method or process disclosed herein, the acts or operations of the method or process may be performed in any suitable sequence and are not necessarily limited to any particular disclosed sequence. Various operations may be described as multiple discrete operations in turn, in a manner that may be helpful in understanding certain embodiments; however, the order of description should not be construed to imply that these operations are order dependent. Additionally, the structures, systems, and/or devices described herein may be embodied as integrated components or as separate components. For purposes of comparing various embodiments, certain aspects and advantages of these embodiments are described. Not necessarily all such aspects or advantages are achieved by any particular embodiment. Thus, for example, various embodiments may be carried out in a manner that achieves or optimizes one advantage or group of advantages as taught herein without necessarily achieving other aspects or advantages as may also be taught or suggested herein.

Certain exemplary embodiments will now be described to provide an overall understanding of the principles of the structure, function, manufacture, and use of the devices and methods disclosed herein. One or more examples of these embodiments are illustrated in the accompanying drawings. Those skilled in the art will understand that the devices and methods specifically described herein and illustrated in the accompanying drawings are non-limiting exemplary embodiments and that the scope of the present invention is defined solely by the claims. The features illustrated or described in connection with one exemplary embodiment may be combined with the features of other embodiments. Such modifications and variations are intended to be included within the scope of the present technology.

Disclosed herein are embodiments of methods and systems for manufacturing spheroidized powders. Some embodiments herein relate to production of metallic powders comprising metals, metal alloys, carbides, nitrides, or other materials which can be difficult to spheroidize. Achieving the desired spheroidal shape, the desired level of porosity (e.g., no porosity to very porous), and the desired composition and microstructure can be difficult. Some embodiments herein relate to the production of metal nitride or metal carbide powders. Titanium nitride is a ceramic with a melting temperature of about 2,930° C. When using plasma processing, the combination of the temperature achieved in a plasma and the residence time of a titanium nitride feedstock may not provide the heat flux needed for the titanium nitride to melt. Spheroidization is only possible if the particles passing through the plasma are fully melted, partially melted, or surface melted. Hence, spheroidization of a titanium nitride feedstock using plasma processing may be difficult. However, spheroidized powders may be useful in a variety of applications including additive manufacturing, such as laser bed systems, electron beam systems and binder jetting systems. For example, 3-dimensional printing of a medical implant using an AM-compatible titanium nitride powders would eliminate expensive, time consuming, and unnecessary processing (e.g., CVD) of the implants and reduce the lead time for manufacturing. Due to the wear resistance and corrosion resistance of the titanium nitride, no other coating may be needed.

In some embodiments, the basic material requirement for additive manufacturing is a metal alloy, metal carbide, or metal nitride powder in spherical form and within a specified particle size, usually in the micron range. One of the most critical attributes to control is the particle size of the powder, as this is a critical parameter in the AM process. Particle size distribution has a direct influence on powder flowability and the ability to provide a uniform, powder bed density. This in turn determines the energy input needed to process the powder grains and also affects the surface finish. For example, a spheroidized powder usable in AM process may have a particle size distribution between about 15-45 microns, about 20-63 microns, or about 45-106 microns. However, according to some of the methods and systems described herein, a spheroidized powder may comprise a particle size distribution in the nanometer range to the millimeter range, in addition to the micrometer ranges generally required for AM processes. For example, a spheroidized powder according to the embodiments herein may comprise a particle size distribution between about 0.1 microns to about 1000 microns. In some embodiments, a spheroidized powder according to the embodiments herein may comprise a particle size distribution between about 0.1 microns and about 1 micron, between about 1 micron and 15 microns, between about 15 microns and about 45 microns, between about 20 microns and 63 microns, between about 45 microns and about 106 microns, between about 106 microns and about 200 microns, between about 200 microns and 300 microns, between about 300 microns and about 400 microns, between about 400 microns and about 500 microns, between about 500 microns and about 600 microns, between about 600 microns and about 700 microns, between about 700 microns and about 800 microns, between about 800 microns and about 900 microns, and between about 900 microns and about 1000 microns, or between any of the aforementioned ranges.

Furthermore, to be useful in additive manufacturing or powder metallurgy (PM) applications that require high powder flow, metal powder particles should exhibit a spherical shape, which can be achieved through the process of plasma spheroidization. This process involves the full melting, surface melting or partial melting of particles in a hot environment whereby surface tension of the liquid metal shapes each particle into a spherical geometry, followed by cooling and re-solidification.

In some embodiments, the final particles achieved by the plasma processing can be spherical, spheroidized, or spheroidal, terms which can be used interchangeably. Advantageously, by using the critical and specific disclosure relevant to each of the different feedstocks disclosed, all of the feedstocks can be transformed into the spherical powders.

Embodiments of the present disclosure are directed to producing particles that are substantially spheroidized or have undergone significant spheroidization. In some embodiments, spherical, spheroidal or spheroidized particles refer to particles having a sphericity greater than a certain threshold. Particle sphericity can be calculated by calculating the surface area of a sphere $A_{s,ideal}$ with a volume matching that of the particle, V using the following equation:

$$r_{ideal} = \sqrt[2]{\frac{3V}{4\pi}}$$

$$A_{s,ideal} = 4\pi r_{ideal}^2$$

The idealized surface area can be compared with the measured surface area of the particle, $A_{s,actual}$:

$$\text{sphericity} = \frac{A_{s,ideal}}{A_{s,actual}}.$$

In some embodiments, particles can have a mean sphericity of greater than 0.5, 0.6, 0.7, 0.75, 0.8, 0.9, 0.91, 0.95, or 0.99 (or greater than about 0.5, about 0.6, about 0.7, about 0.75, about 0.8, about 0.8, about 0.91, about 0.95, or about 0.99). In some embodiments, particles can have a sphericity of 0.75 or greater or 0.91 or greater (or about 0.75 or greater or about 0.91 or greater). In some embodiments, particles can have a sphericity of less than 0.5, 0.6, 0.7, 0.75, 0.8, 0.9, 0.91, 0.95, or 0.99 (or less than about 0.5, about 0.6, about 0.7, about 0.75, about 0.8, about 0.8, about 0.91, about 0.95, or about 0.99). In some embodiments, a particle is considered to be spherical, spheroidal or spheroidized if it has a sphericity at or above any of the aforementioned sphericity values, and in some preferred embodiments, a particle is considered to be spherical if its sphericity is at or about 0.75 or greater or at or about 0.91 or greater.

In some embodiments, a median sphericity of all particles within a given powder can be greater than 0.5, 0.6, 0.7, 0.75, 0.8, 0.9, 0.91, 0.95, or 0.99 (or greater than about 0.5, about 0.6, about 0.7, about 0.75, about 0.8, about 0.8, about 0.91, about 0.95, or about 0.99). In some embodiments, a median sphericity of all particles within a given powder can be less than 0.5, 0.6, 0.7, 0.75, 0.8, 0.9, 0.91, 0.95, or 0.99 (or less than about 0.5, about 0.6, about 0.7, about 0.75, about 0.8, about 0.8, about 0.91, about 0.95, or about 0.99). In some embodiments, a powder is considered to be spheroidized if all or a threshold percentage (as described by any of the fractions below) of the particles measured for the given powder have a median sphericity greater than or equal to any of the aforementioned sphericity values, and in some preferred embodiments, a powder is considered to be spheroidized if all or a threshold percentage of the particles have a median sphericity at or about 0.75 or greater or at or about 0.91 or greater.

In some embodiments, the fraction of particles within a powder that can be above a given sphericity threshold, such as described above, can be greater than 50%, 60%, 70%, 80%, 90%, 95%, or 99% (or greater than about 50%, about 60%, about 70%, about 80%, about 90%, about 95%, or about 99%). In some embodiments, the fraction of particles within a powder that can be above a given sphericity threshold, such as described above, can be less than 50%, 60%, 70%, 80%, 90%, 95%, or 99% (or less than about 50%, about 60%, about 70%, about 80%, about 90%, about 95%, or about 99%).

Particle size distribution and sphericity may be determined by any suitable known technique such as by SEM, optical microscopy, dynamic light scattering, laser diffraction, manual measurement of dimensions using an image analysis software, for example from about 15-30 measures per image over at least three images of the same material section or sample, and any other techniques.

Titanium nitride powder which falls within the above specifications is not currently known, and therefore, AM processes using titanium nitride are not currently known. Some embodiments herein are therefore directed to systems and methods for the manufacture of metal nitride and metal carbide powders at scale, including titanium nitride powders within the specifications required for AM. However, it should be noted that the methods and systems described herein may be applied broadly to a wide spectrum of materials, particularly those that are difficult to spheroidize. With particular reference to titanium nitride, existing production of titanium nitride comprises titanium nitride thin coating on substrates using CVD. However, some embodiments herein are directed to synthesizing, for example, micron sized spherical titanium nitride powder using plasma processing. In some embodiments, the main alloying element is nitrogen. With respect to the composition of the titanium nitride powder, at different nitrogen concentrations, different nitride phases are formed, including TiN, $Ti_2N$, and $TiN_2$. These phases have different physical properties. For example, TiN is a very hard phase with high wear resistance and $Ti_2N$ may be a relatively softer phase. Thus, based on the application and the required functional properties, different compositions and different microstructures will be desired. The embodiments herein may be directed to synthesis of titanium nitride of any desired phase, wherein the phase can be controlled by controlling the stoichiometry of a reactive plasma gas.

In some embodiments, a method for manufacturing a spheroidized metal-containing powder (e.g., metal nitride powder) may comprise using a metal powder (e.g., Ti powder) as a precursor or feedstock, and a reactive plasma gas (e.g., $N_2$) as a reactive gas species to synthesize the spheroidized metal-containing powder. For example, in some embodiments, a method for manufacturing a spheroidized metal nitride or carbide powder involves using commercially pure metal powder, such as commercially pure titanium powder (cpTi), as a feedstock and nitrogen or carbon-containing gas as a reactive plasma gas to synthesize metal nitride or metal carbide powder respectively. In some embodiments, the feedstock may instead comprise a liquid metal. In some embodiments, the metal powder feedstock may be preprocessed before introduction to the plasma. In some embodiments, the feedstock may be generally spherical, or generally non-spherical powder. Although the feedstock herein is generally described with respect to titanium powder, the feedstock may also comprise other metal powders, such as B, Al, or Si to form, for example, boron nitride, aluminum nitride, silicon nitride, respectively.

In some embodiments, the metal in a metal powder feedstock may react with the reactive gas species to form the spheroidized metal-containing powder within the plasma. For example, titanium has a great affinity towards interstitials such as nitrogen, hydrogen, carbon, and oxygen. These species, when present in plasma gas, are in an ionized state and are considered more "reactive". By purposefully choosing the reactive plasma gas, which may comprise nitrogen and varying amounts of other gases such as hydrogen, argon, helium, xenon, krypton, or other "non-reactive" gases, and passing the cpTi powder through the reactive plasma gas substantially instantaneously, the reactive plasma gas may react with Ti to form spheroidized powder, such as titanium nitride powder. In some embodiments, by controlling the amount of reactive gas (e.g., $N_2$) in the plasma and the residence time of the metal powder particles in the plasma, it may be possible to control the stoichiometry (e.g., % of N in the compound) of metal-containing spheroidized powder produced. In conventional methods of processing titanium feedstock using plasma processing, nitrogen-containing plasma gases are generally not used. This is due to the very high affinity of Ti towards N, which was thought to form a nitride surface layer on the titanium particle. However, using the embodiments herein, it has unexpectedly been found that nitrogen-containing plasma gas may react with titanium feedstock through the complete mass of the titanium particle, leading to the unexpected result of spheroidized titanium nitride powder. Thus, the embodiments herein differ from conventional methods involving the plasma processing of titanium and similar feedstocks.

FIG. 1 illustrates an example flowchart of a process for producing a spheroidized metal-containing powder according to some embodiments described herein. In some embodiments, a method for manufacturing a spheroidized metal-containing powder may comprise providing a metal powder as a feedstock at 100. For example, the metal powder may comprise titanium powder such as, for example, commercially pure titanium (cpTi) powder, gas atomized titanium powder, hydride-dehydride (HDH) titanium powder, or titanium hydride powder. In some embodiments, the method may further comprise introducing the feedstock into a microwave plasma to form the spheroidized metal-containing powder at 102. In some embodiments, the microwave plasma may be generated by subjecting a reactive plasma gas, for example, nitrogen-containing (e.g., $N_2$) or carbon-containing (e.g., hydrocarbons) gas, to microwaves produced by a microwave power source. In some embodiments, the reactive plasma gas may also comprise one or more of hydrogen, helium, neon, argon, krypton, or xenon. In some embodiments, a spheroidized metal-containing powder may be formed at 104 by a chemical reaction between the feedstock and the reactive plasma gas. In some embodiments, the spheroidized metal-containing powder comprises a particle-size distribution between 15-106 microns. In some embodiments, the spheroidized metal-containing powder comprises spheroidized titanium nitride powder. In some embodiments, the spheroidized titanium nitride powder comprises one or more phases of titanium nitride, such as TiN, $Ti_2N$, or $TiN_2$.

Some embodiments of the disclosed process can include feeding the powder feedstock using a powder feeder into a microwave generated reactive plasma, wherein the power density, gas flows and residence time of the powder feedstock are controlled. The desired process parameters such as power density, flow rates and residence time of the powder in the reactive plasma can depend on the physical characteristics of the feedstock metal, such as the melting point and thermal conductivity.

Some embodiments herein relate to a process of spheroidization of metals or metal alloys using a microwave generated plasma. In some embodiments, the powder feedstock is entrained in an inert and/or reducing gas environment and injected into the microwave plasma environment. Upon injection into a hot plasma, which may comprise a plasma plume or exhaust of a plasma torch, the feedstock is spheroidized and released into a chamber filled with an inert gas and directed into hermetically sealed drums where is it stored. In some embodiments, injection of feedstock into a plasma comprises injection of the feedstock into the plasma plume or plasma exhaust. This process can be carried out at atmospheric pressure, in a partial vacuum, or at a slightly higher pressure than atmospheric pressure. In alternative embodiments, the process can be carried out in a low, medium, or high vacuum environment. The process can run continuously or in a batch process, and the collector vessels may be replaced as they fill up with spheroidized metal or metal alloy particles. The rate of cooling of the spheroidized metal and metal alloys can be controlled to strategically influence the microstructure of the spheroidized powder. By controlling the process parameters such as cooling gas flow rate, residence time, cooling gas composition etc., a microstructure of the metal and metal alloys can be controlled. The precise cooling rates required to form these structures is largely a function of the type and quantity of the alloying elements within the material.

In some embodiments, within the plasma, plasma plume, or exhaust of the plasma torch, the melted metals are inherently spheroidized due to liquid surface tension. As the microwave generated plasma exhibits a substantially uniform temperature profile, more than 90% spheroidization of particles could be achieved (e.g., 91%, 93%, 95%, 97%, 99%, 100%). After exiting the plasma, the particles are cooled before entering collection bins. When the collection bins fill, they can be removed and replaced with an empty bin as needed without stopping the process.

Figure 2:
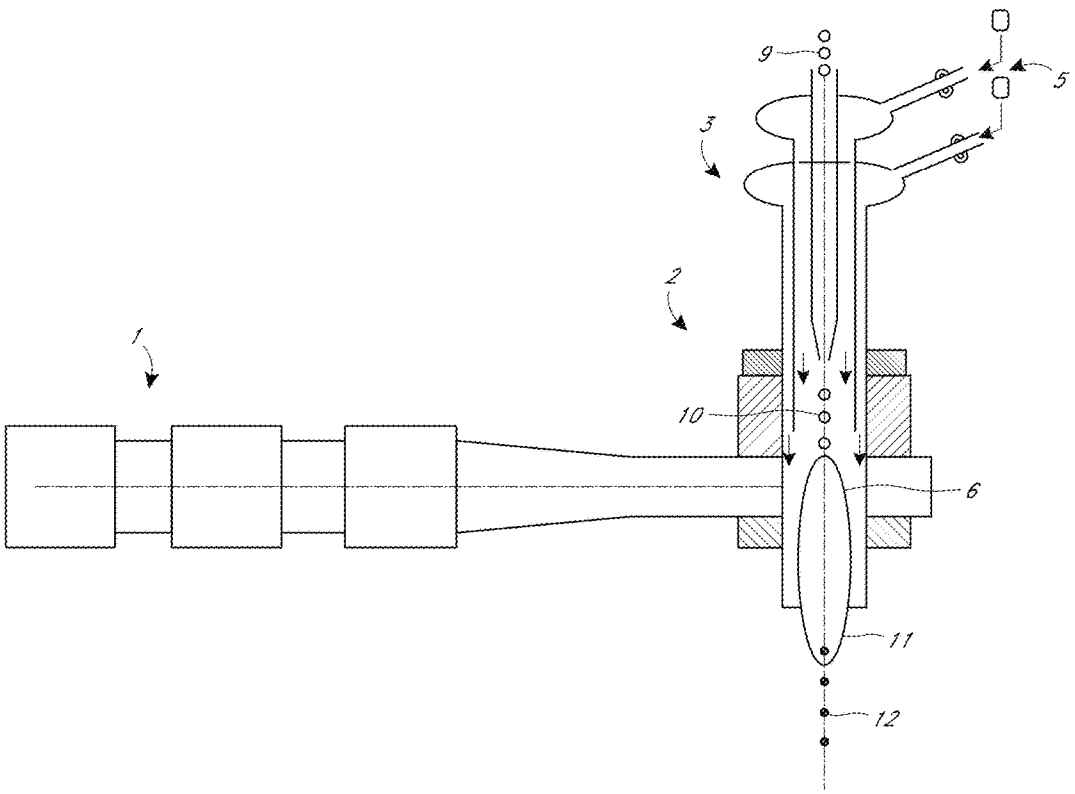
FIG. 2 illustrates an example diagram of a microwave plasma torch according to some embodiments described herein.

FIG. 2 illustrates an exemplary microwave plasma torch that can be used in the production of spheroidal metal or metal alloy powders, according to some embodiments herein. As discussed above, metal feed materials 9, 10 can be introduced into a microwave plasma torch 2, which sustains a microwave generated plasma 11. In some embodiments, a microwave plasma torch may include a side feeding hopper rather than the top feeding hopper 3 shown in the embodiment of FIG. 2, thus allowing for downstream feeding. Thus, in this implementation the feedstock is injected after the microwave plasma torch applicator for processing in the "plume" or "exhaust" 6 of the microwave plasma torch. Thus, the plasma of the microwave plasma torch is engaged at the exit end of the plasma torch to allow downstream feeding of the feedstock, as opposed to the top-feeding (or upstream feeding) discussed with respect to FIG. 2. Other feeding configurations may include one or several individual feeding nozzles surrounding the plasma plume. The feedstock powder can enter the plasma from any direction and can be fed in 360° around the plasma. The feedstock powder can enter the plasma at a specific position along the length of the plasma plume where a specific temperature has been measured and a residence time estimated for sufficient melting of the particles. The melted particles exit the plasma into a sealed chamber where they are quenched then collected.

In some embodiments, an entrainment gas flow, and a sheath flow (downward arrows) may be injected through inlets 5 to create flow conditions within the plasma torch prior to ignition of the plasma 11 via microwave radiation source 1. In some embodiments, the entrainment flow and sheath flow are both axis-symmetric and laminar, while in other embodiments the gas flows are swirling. The feed materials 9 may be introduced axially or otherwise into the microwave plasma torch, where they are entrained by a gas flow that directs the materials toward the plasma. Within the microwave generated plasma, the feed materials are melted in order to spheroidize the materials and chemical reactions between the feedstock and reactive plasma gases may occur. Inlets 5 can be used to introduce process gases to entrain and accelerate particles 9, 10 along axis 12 towards plasma 11. First, particles 9 are accelerated by entrainment using a core laminar gas flow (upper set of arrows) created through an annular gap within the plasma torch. A second laminar flow (lower set of arrows) can be created through a second annular gap to provide laminar sheathing for the inside wall of dielectric torch 2 to protect it from melting due to heat radiation from plasma 11. In some embodiments, the laminar flows direct particles 9, 10 toward the plasma 11 along a path as close as possible to axis 12, exposing them to a substantially uniform temperature within the plasma 11. In some embodiments, suitable flow conditions are present to keep particles 10 from reaching the inner wall of the plasma torch 2 where plasma attachment could take place. Particles 9, 10 are guided by the gas flows towards microwave plasma 11 were each undergoes homogeneous thermal treatment. Various parameters of the microwave generated plasma, as well as particle parameters, may be adjusted in order to achieve desired results. These parameters may include microwave power, feedstock material size, feedstock material insertion rate, gas flow rates, plasma temperature, residence time, and cooling rates. In some embodiments, the gas flows are laminar; however, in alternative embodiments, swirl flows or turbulent flows may be used to direct the feed materials toward the plasma.

Examples

Titanium nitride powder was synthesized from cpTi powder within a microwave plasma using nitrogen gas as a reactive plasma gas. The titanium nitride powder exhibited a 45-106 micron particle-size distribution (PSD) and was synthesized using a microwave plasma generated using a nitrogen gas ($N_2$) as a plasma gas. The cpTi, which was made by the HDH method, was treated in a reactive plasma comprising a mixture of nitrogen ($N_2$) and hydrogen ($H_2$). A small amount of hydrogen (~10%) was introduced in the reactive nitrogen gas to prevent oxidation of the cpTi powder during the plasma treatment. The plasma treatment transformed the irregular shaped HDH cpTi powder into a spherical titanium nitride powder. During spheroidization, due to the high temperatures and the contact between ionized nitrogen species in the plasma with fully melted, surface melted or partially melted cpTi particles, a reaction between Ti and N was initiated, resulting in titanium nitride, $Ti_xN_y$. Example reactions are shown below:

$$2Ti(s) + N_2(g) \rightarrow 2TiN(s)$$

$$4Ti(s) + N_2(g) \rightarrow 2Ti_2N(s)$$

The titanium nitride synthesized had the following elemental composition: nitrogen at 12% by weight, oxygen at 0.34% by weight, iron at 0.034% by weight, carbon at 0.0068% by weight, and titanium at 85.9% by weight. The titanium nitride synthesized had a particle size distribution wherein $D_{10}$ was 50.35 microns, $D_{50}$ was 68.5 microns, and $D_{90}$ was 97.73 microns. The titanium nitride synthesized had the following physical properties: Hall Flow of 27 s/50 g, apparent density (AD) of 2.54 g/cubic cm, true density of 4.9 g/cubic cm, and tapped density (TD) of 2.91 g/cubic cm.

Figure 3:
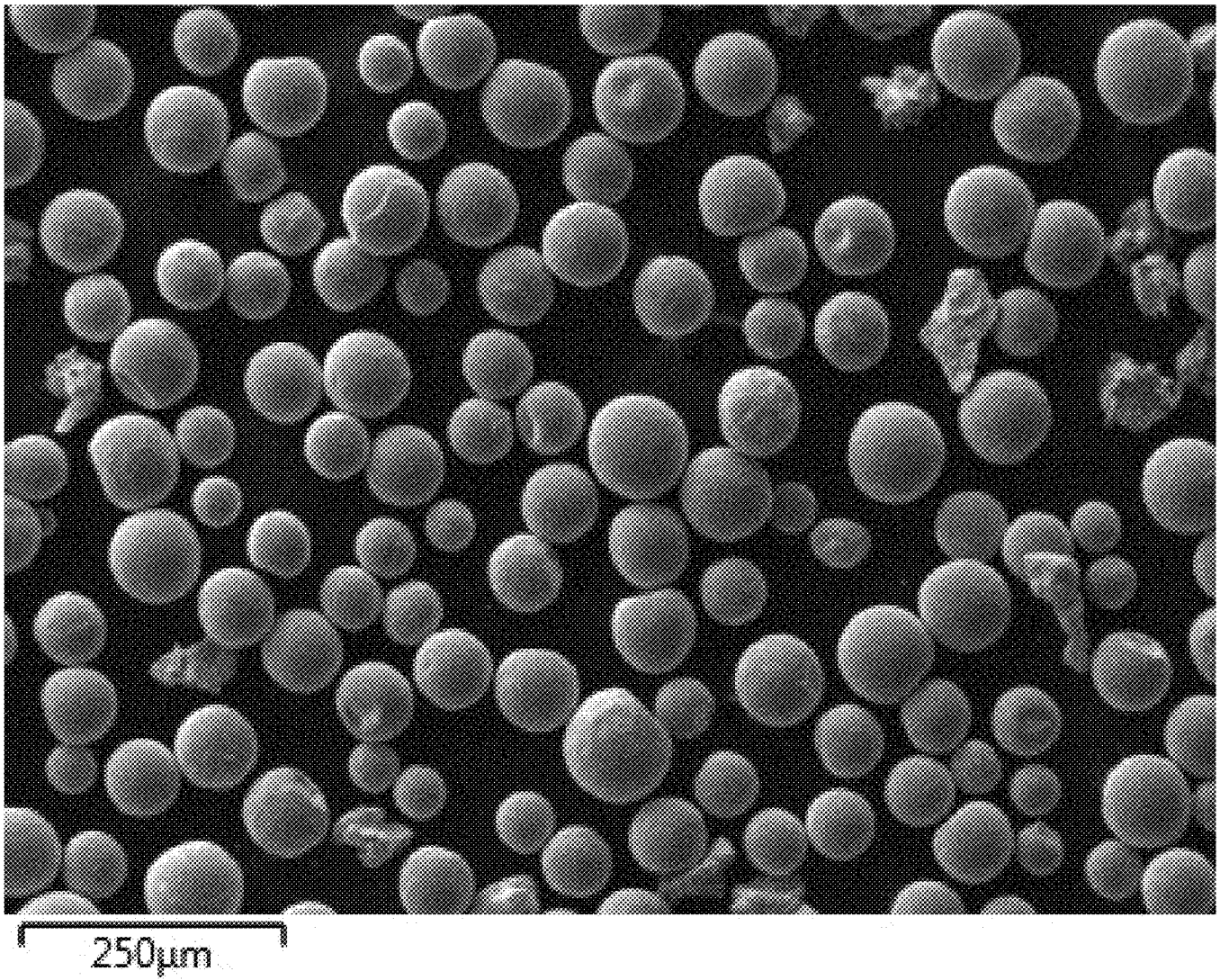
FIG. 3 illustrates an example morphology of titanium nitride powder produced according to some embodiments described herein.

FIG. 3 illustrates an example morphology of titanium nitride powder synthesized according to some embodiments described herein. As shown, the particles of the titanium nitride powder are substantially spherical, such that use of the powder in an AM process is possible.

Figure 4:
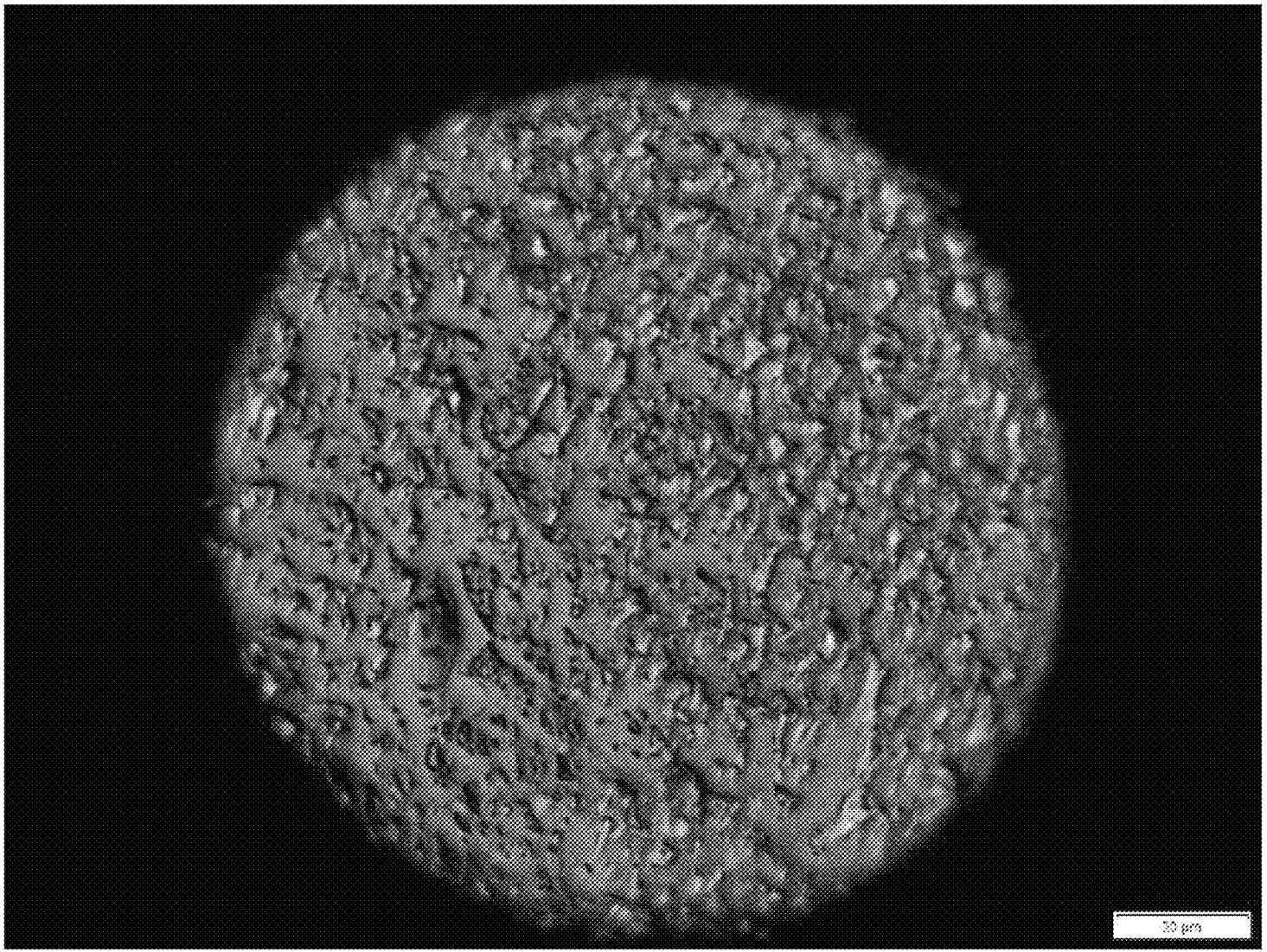
FIG. 4 illustrates an example microstructure of titanium nitride powder produced according to some embodiments described herein.

FIG. 4 illustrates an example microstructure of titanium nitride powder synthesized according to some embodiments described herein. In some embodiments, the microstructure of the titanium nitride powder may comprise one or more separate phases. For example, in some embodiments, phases may include α-Ti, TiN, $Ti_2N$, or $TiN_2$. In some embodiments, a titanium nitride shell will be formed with cpTi core. Whether a titanium nitride shell is formed or the powder comprises titanium nitride throughout the particles depends on the processing conditions within the plasma torch. In the illustrated microstructure of FIG. 4, the microstructure represents a Ti matrix with TiN and $Ti_2N$ phases dispersed in the matrix.

Figure 5:
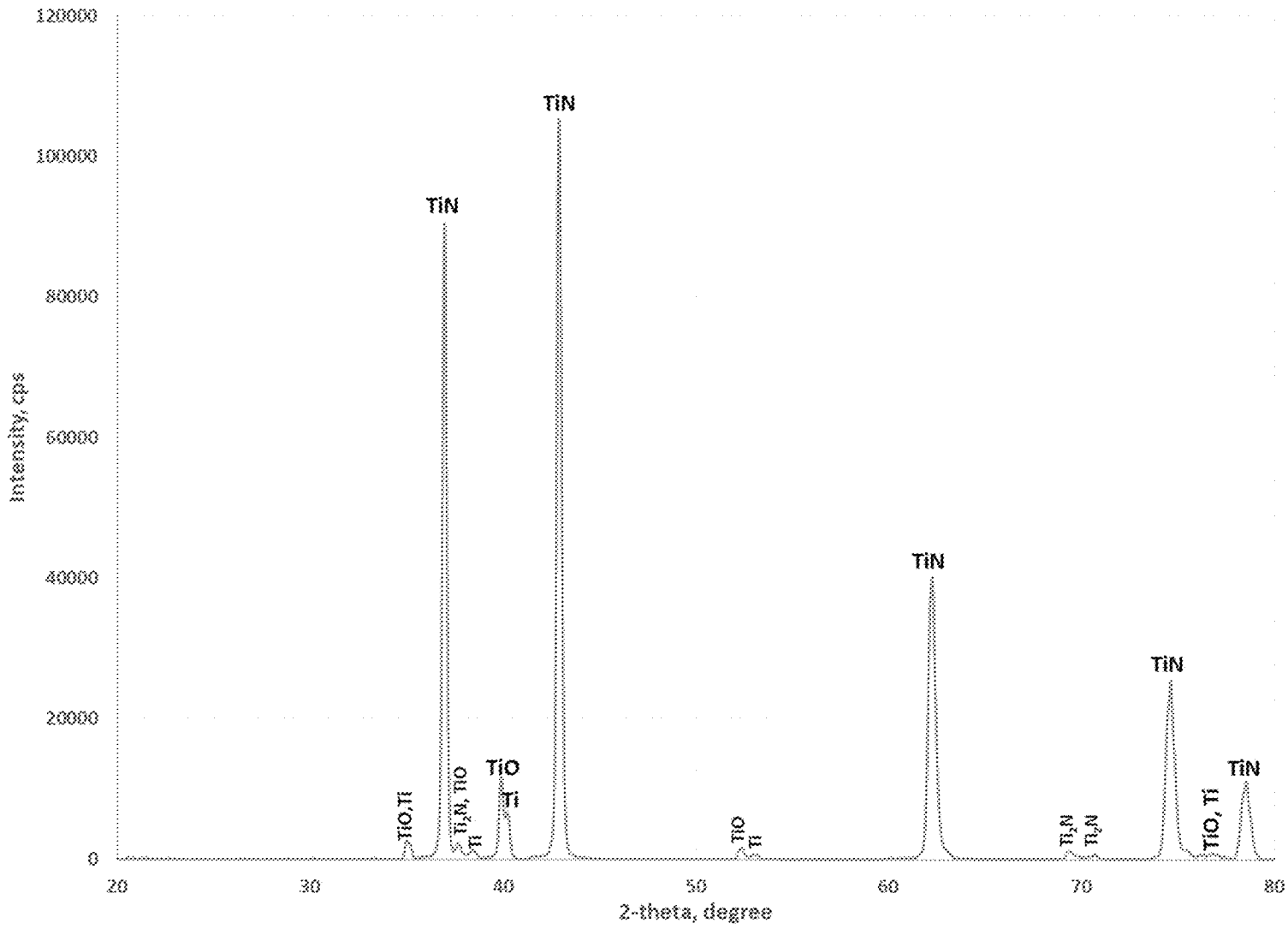
FIG. 5 illustrates an example X-ray powder diffraction of a titanium powder produced according to some embodiments described herein.

FIG. 5 illustrates an example X-ray powder diffraction of a titanium nitride powder synthesized according to some embodiments described herein. As illustrated, the powder is generally formed of TiN with TiO, Ti, and $Ti_2N$.

Figure 6:
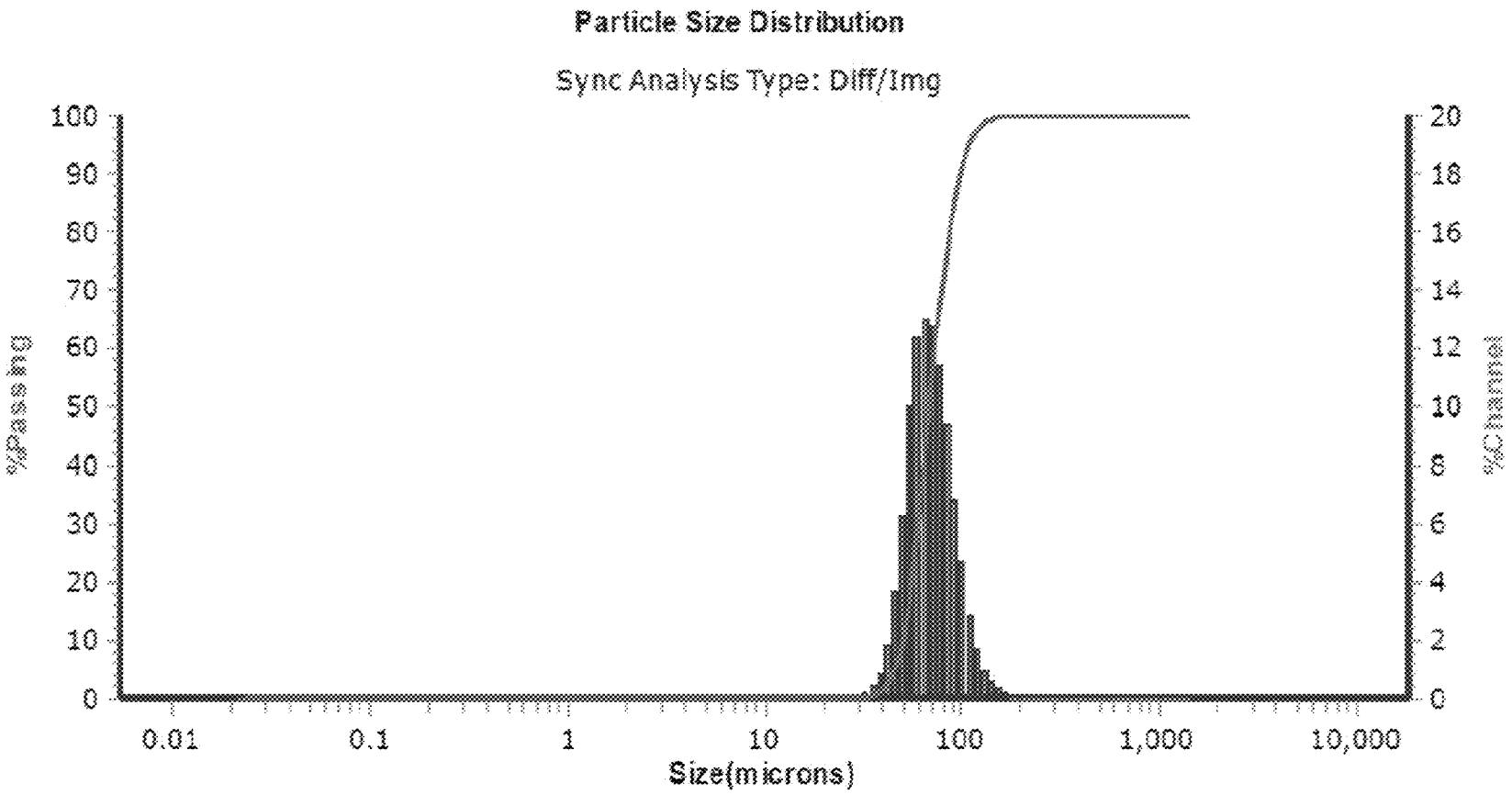
FIG. 6 illustrates an example particle size distribution of a titanium powder produced according to some embodiments described herein.

FIG. 6 illustrates an example particle size distribution of a titanium nitride powder synthesized according to some embodiments described herein. In some embodiments, a titanium nitride powder may comprise a particle size distribution between about 15 microns and about 150 microns.

Additional Embodiments

In the foregoing specification, the invention has been described with reference to specific embodiments thereof. It will, however, be evident that various modifications and changes may be made thereto without departing from the broader spirit and scope of the invention. The specification and drawings are, accordingly, to be regarded in an illustrative rather than restrictive sense.

Indeed, although this invention has been disclosed in the context of certain embodiments and examples, it will be understood by those skilled in the art that the invention extends beyond the specifically disclosed embodiments to other alternative embodiments and/or uses of the invention and obvious modifications and equivalents thereof. In addition, while several variations of the embodiments of the invention have been shown and described in detail, other modifications, which are within the scope of this invention, will be readily apparent to those of skill in the art based upon this disclosure. It is also contemplated that various combinations or sub-combinations of the specific features and aspects of the embodiments may be made and still fall within the scope of the invention. It should be understood that various features and aspects of the disclosed embodiments can be combined with, or substituted for, one another in order to form varying modes of the embodiments of the disclosed invention. Any methods disclosed herein need not be performed in the order recited. Thus, it is intended that the scope of the invention herein disclosed should not be limited by the particular embodiments described above.

It will be appreciated that the systems and methods of the disclosure each have several innovative aspects, no single one of which is solely responsible or required for the desirable attributes disclosed herein. The various features and processes described above may be used independently of one another or may be combined in various ways. All possible combinations and sub combinations are intended to fall within the scope of this disclosure.

Certain features that are described in this specification in the context of separate embodiments also may be implemented in combination in a single embodiment. Conversely, various features that are described in the context of a single embodiment also may be implemented in multiple embodiments separately or in any suitable sub combination. Moreover, although features may be described above as acting in certain combinations and even initially claimed as such, one or more features from a claimed combination may in some cases be excised from the combination, and the claimed combination may be directed to a sub combination or variation of a sub combination. No single feature or group of features is necessary or indispensable to each and every embodiment.

It will also be appreciated that conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without author input or prompting, whether these features, elements and/or steps are included or are to be performed in any particular embodiment. The terms "comprising," "including," "having," and the like are synonymous and are used inclusively, in an open-ended fashion, and do not exclude additional elements, features, acts, operations, and so forth. In addition, the term "or" is used in its inclusive sense (and not in its exclusive sense) so that when used, for example, to connect a list of elements, the term "or" means one, some, or all of the elements in the list. In addition, the articles "a," "an," and "the" as used in this application and the appended claims are to be construed to mean "one or more" or "at least one" unless specified otherwise. Similarly, while operations may be depicted in the drawings in a particular order, it is to be recognized that such operations need not be performed in the particular order shown or in sequential order, or that all illustrated operations be performed, to achieve desirable results. Further, the drawings may schematically depict one more example processes in the form of a flowchart. However, other operations that are not depicted may be incorporated in the example methods and processes that are schematically illustrated. For example, one or more additional operations may be performed before, after, simultaneously, or between any of the illustrated operations. Additionally, the operations may be rearranged or reordered in other embodiments. In certain circumstances, multitasking and parallel processing may be advantageous. Moreover, the separation of various system components in the embodiments described above should not be understood as requiring such separation in all embodiments, and it should be understood that the described program components and systems may generally be integrated together in a single software product or packaged into multiple software products. Additionally, other embodiments are within the scope of the following claims. In some cases, the actions recited in the claims may be performed in a different order and still achieve desirable results.

Further, while the methods and devices described herein may be susceptible to various modifications and alternative forms, specific examples thereof have been shown in the drawings and are herein described in detail. It should be understood, however, that the invention is not to be limited to the particular forms or methods disclosed, but, to the contrary, the invention is to cover all modifications, equivalents, and alternatives falling within the spirit and scope of the various implementations described and the appended claims. Further, the disclosure herein of any particular feature, aspect, method, property, characteristic, quality, attribute, element, or the like in connection with an implementation or embodiment can be used in all other implementations or embodiments set forth herein. Any methods disclosed herein need not be performed in the order recited. The methods disclosed herein may include certain actions taken by a practitioner; however, the methods can also include any third-party instruction of those actions, either expressly or by implication. The ranges disclosed herein also encompass any and all overlap, sub-ranges, and combinations thereof. Language such as "up to," "at least," "greater than," "less than," "between," and the like includes the number recited. Numbers preceded by a term such as "about" or "approximately" include the recited numbers and should be interpreted based on the circumstances (e.g., as accurate as reasonably possible under the circumstances, for example±5%, ±10%, ±15%, etc.). For example, "about 3.5 mm" includes "3.5 mm." Phrases preceded by a term such as "substantially" include the recited phrase and should be interpreted based on the circumstances (e.g., as much as reasonably possible under the circumstances). For example, "substantially constant" includes "constant." Unless stated otherwise, all measurements are at standard conditions including temperature and pressure.

As used herein, a phrase referring to "at least one of" a list of items refers to any combination of those items, including single members. As an example, "at least one of: A, B, or C" is intended to cover: A, B, C, A and B, A and C, B and C, and A, B, and C. Conjunctive language such as the phrase "at least one of X, Y and Z," unless specifically stated otherwise, is otherwise understood with the context as used in general to convey that an item, term, etc. may be at least one of X, Y or Z. Thus, such conjunctive language is not generally intended to imply that certain embodiments require at least one of X, at least one of Y, and at least one of Z to each be present. The headings provided herein, if any, are for convenience only and do not necessarily affect the scope or meaning of the devices and methods disclosed herein.

Accordingly, the claims are not intended to be limited to the embodiments shown herein but are to be accorded the widest scope consistent with this disclosure, the principles and the novel features disclosed herein.

What is claimed is:

1. A spheroidized titanium nitride powder comprising:

a plurality of titanium nitride particles exhibiting a substantially spherical shape, the plurality of titanium nitride particles comprising a particle-size distribution between 15-106 microns and the plurality of titanium nitride particles comprising at least one of the following phases: α-Ti, TiN, $Ti_2N$, or $TiN_2$, wherein the spheroidized titanium nitride powder is synthesized by processing a solid feedstock, and wherein the plurality of particles comprise titanium nitride throughout the particles.

2. The spheroidized titanium nitride powder of claim 1, wherein the solid feedstock is a titanium feedstock and the spheroidized titanium nitride powder is synthesized by microwave plasma processing of the titanium feedstock.

3. The spheroidized titanium nitride powder of claim 2, wherein the plurality of particles comprise a microstructure formed by reacting the titanium feedstock with a nitrogen-containing plasma gas.

4. The spheroidized titanium nitride powder of claim 1, wherein the plurality of particles have a mean sphericity greater than 0.75.

5. The spheroidized titanium nitride powder of claim 1, wherein the plurality of particles have a median sphericity greater than 0.75.

6. The spheroidized titanium nitride powder of claim 1, wherein the spheroidized titanium nitride powder is manufactured by a method comprising:

providing the solid feedstock to a microwave plasma torch, the feedstock comprising titanium powder;

introducing the feedstock into a microwave plasma generated by the microwave plasma torch, the microwave plasma generated by subjecting a reactive plasma gas to microwaves from a microwave power source, the reactive plasma gas comprising at least nitrogen-containing gas; and forming the spheroidized titanium nitride powder, the spheroidized titanium nitride powder formed by at least partially melting the feedstock and initiating a chemical reaction between the feedstock and the reactive plasma gas within the microwave plasma torch, and the spheroidized titanium nitride powder comprising one or more particles, the one or more particles comprising titanium nitride throughout a complete mass of the one or more particles, wherein the one or more particles comprise a pre-determined concentration of nitrogen by controlling an amount of the nitrogen-containing gas and a residence time of the feedstock in the reactive plasma gas.

7. The spheroidized titanium nitride powder of claim 6, wherein the method further comprises selecting a desired porosity, composition, or microstructure of the spheroidized titanium nitride powder, and wherein the spheroidized titanium nitride powder comprises the desired porosity, composition, or microstructure.

8. The spheroidized titanium nitride powder of claim 6, wherein the titanium powder comprises gas atomized titanium powder, hydride-dehydride (HDH) titanium powder, or hydrided titanium powder.

9. The spheroidized titanium nitride powder of claim 6, wherein the nitrogen-containing gas comprises one or more of hydrogen, helium, neon, argon, krypton, or xenon.

10. The spheroidized titanium nitride powder of claim 6, wherein the reactive plasma gas comprises nitrogen gas ($N_2$).

11. The spheroidized titanium nitride powder of claim 6, wherein the chemical reaction comprises:

$$2Ti + N_2 \rightarrow 2TiN; \text{ or}$$

$$4Ti + N_2 \rightarrow 2Ti_2N.$$

12. The spheroidized titanium nitride powder of claim 1, wherein the spheroidized titanium nitride powder is manufactured by a method comprising:

providing a metal powder as the solid feedstock to a microwave plasma torch;

introducing the feedstock into a microwave plasma generated by the microwave plasma torch, the microwave plasma generated by subjecting a nitrogen-containing gas to microwaves from a microwave power source; and forming the spheroidized titanium nitride powder, the spheroidized titanium nitride powder formed by at least partially melting the feedstock and initiating a chemical reaction between the feedstock and the nitrogen-containing gas within the microwave plasma torch, and the spheroidized titanium nitride powder comprising one or more particles, the one or more particles comprising titanium nitride throughout a complete mass of the one or more particles, wherein the one or more particles comprise a pre-determined concentration of nitrogen by controlling an amount of the nitrogen-containing gas and a residence time of the feedstock in the reactive plasma gas.

13. The spheroidized titanium nitride powder of claim 12, wherein the method further comprises selecting a desired porosity, composition, or microstructure of the spheroidized titanium nitride powder, and wherein the spheroidized titanium nitride powder comprises the desired porosity, composition, or microstructure.

14. The spheroidized titanium nitride powder of claim 12, wherein the metal powder comprises gas atomized titanium powder, hydride-dehydride (HDH) titanium powder, or hydrided titanium powder.

15. The spheroidized titanium nitride powder of claim 12, wherein the nitrogen-containing gas comprises one or more of hydrogen, helium, neon, argon, krypton, or xenon.

16. The spheroidized titanium nitride powder of claim 12, wherein the reactive plasma gas comprises nitrogen gas ($N_2$).

* * * * *